US009605477B2

(12) United States Patent
Huang et al.

(10) Patent No.: US 9,605,477 B2
(45) Date of Patent: Mar. 28, 2017

(54) WINDOW SHADE AND ACTUATING SYSTEM THEREOF

(71) Applicant: TEH YOR CO, LTD., Taipei (TW)

(72) Inventors: Chin-Tien Huang, New Taipei (TW); Fu-Lai Yu, New Taipei (TW)

(73) Assignee: Teh Yor Co., Ltd. (TW)

( * ) Notice: Subject to any disclaimer, the term of this patent is extended or adjusted under 35 U.S.C. 154(b) by 139 days.

(21) Appl. No.: 14/582,296

(22) Filed: Dec. 24, 2014

(65) Prior Publication Data

US 2016/0138331 A1 May 19, 2016

(30) Foreign Application Priority Data

Nov. 17, 2014 (TW) ..... 103139810 A

(51) Int. Cl.
*E06B 9/32* (2006.01)
*E06B 9/322* (2006.01)
(Continued)

(52) U.S. Cl.
CPC ..... *E06B 9/322* (2013.01); *E06B 9/303* (2013.01); *E06B 9/88* (2013.01); *E06B 2009/3222* (2013.01)

(58) Field of Classification Search
CPC . E06B 9/322; E06B 9/32; E06B 9/324; E06B 9/303; E06B 9/307; E06B 9/308; E06B 9/30; E06B 9/306; E06B 9/305
(Continued)

(56) References Cited

U.S. PATENT DOCUMENTS 4,200,135 A * 4/1980 Hennequin ..... E06B 9/32 160/168.1 R
4,334,572 A * 6/1982 Frei ..... E06B 9/322 160/170
(Continued)

FOREIGN PATENT DOCUMENTS

CH 676869 A5 * 3/1991 ..... E06B 9/307
CH GB 2370308 A * 6/2002 ..... E06B 9/322
(Continued)

OTHER PUBLICATIONS

International search report and written opinion of the international searching authority for co-pending PCT application No. PCT/US2014/072337 mailed Jul. 8, 2015.
(Continued)

*Primary Examiner* — Kaherine Mitchell
*Assistant Examiner* — Johnnie A Shablack
(74) *Attorney, Agent, or Firm* — Baker & McKenzie LLP; David I. Roche

(57) ABSTRACT

An actuating system for a window shade includes a suspension member, a casing having a fixed protrusion, a transmission axle disposed through the casing, a rotary drum arranged in the casing and rotationally coupled with the transmission axle, and an impeding part connected with the rotary drum and affixed with an end of the suspension member. The rotary drum is rotatable in a first direction for winding the suspension member, and in a second direction for unwinding the suspension member. The impeding part is movable relative to the rotary drum between a first and a second position, the impeding part when in the first position being movable with the rotary drum past the protrusion in any of the first and second direction, and the impeding part when in the second position being engageable with the
(Continued)

protrusion to block rotation of the rotary drum in the second direction.

33 Claims, 28 Drawing Sheets

(51) Int. Cl.
*E06B 9/303* (2006.01)
*E06B 9/88* (2006.01)

(58) Field of Classification Search
USPC ... 160/168.1 R, 173 R, 174 R, 175, 176.1 R, 160/177 R, 178.1 R, 170, 300–304.1, 291, 160/293.1
See application file for complete search history.

(56) References Cited

U.S. PATENT DOCUMENTS 4,372,432 A * 2/1983 Waine ..... E06B 9/78 160/307
4,444,243 A * 4/1984 Voney ..... E06B 9/32 160/172 R
4,522,244 A * 6/1985 Brolin ..... E06B 9/307 160/170
5,031,681 A * 7/1991 Dodich ..... E06B 9/307 160/176.1 R
5,103,888 A * 4/1992 Nakamura ..... E06B 9/308 160/171
5,167,269 A * 12/1992 Abo ..... E06B 9/90 160/305
5,628,356 A * 5/1997 Marocco ..... E06B 9/308 160/170
5,638,882 A * 6/1997 Morris ..... E06B 9/308 160/176.1 R
5,791,393 A * 8/1998 Judkins ..... E06B 9/322 160/308
5,934,350 A * 8/1999 Ciuca ..... E06B 9/307 160/176.1 R
6,116,325 A * 9/2000 Colson ..... E06B 9/32 160/321
6,378,594 B1 * 4/2002 Yamanaka ..... E06B 9/80 160/238
6,435,252 B2 * 8/2002 Colson ..... E06B 9/32 160/121.1
6,655,088 B1 * 12/2003 Hormann ..... E06B 9/84 160/302
6,782,938 B2 * 8/2004 Colson ..... E06B 9/32 160/121.1
6,786,268 B2 * 9/2004 Corey ..... E06B 9/32 160/176.1 R
7,128,126 B2 * 10/2006 Smith ..... E06B 9/262 160/121.1
7,178,577 B2 * 2/2007 Liu ..... E06B 9/32 160/170
7,198,089 B2 * 4/2007 Hsu ..... E06B 9/322 160/170
7,287,569 B2 * 10/2007 Lin ..... E06B 9/303 160/170
7,341,091 B2 * 3/2008 Nien ..... E06B 9/322 160/170
8,079,398 B2 * 12/2011 Tsukamoto ..... E06B 9/32 160/115
8,186,413 B2 * 5/2012 Fujita ..... E06B 9/34 160/121.1
8,281,843 B2 * 10/2012 Yu ..... E06B 9/303 160/170
8,356,653 B2 * 1/2013 Fu-Lai ..... E06B 9/322 160/170
8,485,242 B2 * 7/2013 Fraser ..... E06B 9/322 160/115
8,851,143 B2 * 10/2014 Zhu ..... E06B 9/38 160/121.1
9,027,627 B2 * 5/2015 Muto ..... E06B 9/262 160/84.03
9,078,537 B2 * 7/2015 Lee ..... A47H 5/032
2003/0085003 A1 * 5/2003 Cheng ..... E06B 9/42 160/321
2007/0102554 A1 * 5/2007 Chen ..... E06B 9/322 242/389
2008/0251624 A1 * 10/2008 Fraczek ..... E06B 9/322 242/389
2013/0220561 A1 * 8/2013 Yu ..... E06B 9/322 160/340
2016/0017964 A1 * 1/2016 Yu ..... E06B 9/32 160/168.1 P
2016/0138331 A1 * 5/2016 Huang ..... E06B 9/322 160/189

FOREIGN PATENT DOCUMENTS

CN 200982151 Y 11/2007
CN 101300399 B 7/2012
CN 102162330 B 10/2014
DE 3625365 A1 * 2/1988 ..... E06B 9/307
DK WO 2005028801 A1 * 3/2005 ..... E06B 9/322
FR EP 1983143 A1 * 10/2008 ..... E06B 9/308
GB 2370308 A 6/2002
IL WO 2014006624 A1 * 1/2014 ..... E06B 9/262
WO 2005028801 A1 3/2005
WO 2014006624 A1 1/2014

OTHER PUBLICATIONS

Office Action issued on Feb. 17, 2016 and cited references in corresponding TW Patent Application No. 103139810.
One document containing English translations of the Abstracts for the 3 cited Chinese references.

* cited by examiner

WINDOW SHADE AND ACTUATING SYSTEM THEREOF

CROSS-REFERENCE TO RELATED APPLICATION(S)

This patent application claims priority to Taiwan Patent Application No. 103139810 filed on Nov. 17, 2014, which is incorporated herein by reference.

BACKGROUND

1. Field of the Invention

The present inventions relate to window shades, and actuating systems used in window shades.

2. Description of the Related Art

Many types of window shades are currently available on the market, such as Venetian blinds, roller shades and honeycomb shades. The shade when lowered can cover the area of the window frame, which can reduce the amount of light entering the room through the window and provided increased privacy. Conventionally, the window shade is provided with an operating cord that can be actuated to raise or lower the window shade. The window shade can be raised by winding a suspension member around a rotary drum, and lowered by unwinding the suspension member from the rotary drum. In order to ensure that the window shade can be operated in a consistent manner, a limiting mechanism may also be provided to stop the rotary drum when it reaches a lowermost position. However, the conventional limiting mechanism is usually constructed as a distinct device that requires additional space for assembly, which may result in a more complex structure of the window shade.

Therefore, there is a need for a window shade that has an improved actuating system, is convenient to operate and address at least the foregoing issues.

SUMMARY

The present application describes a window shade and an actuating system for use with the window shade. In one embodiment, the actuating system includes a suspension member, a casing having a fixed protrusion, a transmission axle disposed through the casing, a rotary drum arranged in the casing and rotationally coupled with the transmission axle, and an impeding part connected with the rotary drum and affixed with an end of the suspension member. The rotary drum is rotatable in a first direction for winding the suspension member around the rotary drum, and in a second direction for unwinding the suspension member from the rotary drum. The impeding part is movable relative to the rotary drum between a first and a second position, the impeding part when in the first position being movable with the rotary drum past the protrusion in any of the first and second direction, and the impeding part when in the second position being engageable with the protrusion to block rotation of the rotary drum in the second direction.

At least one advantage of the window shades described herein is the ability to integrate a limiting mechanism with a winding unit of the window shade, which can reduce the overall space occupied by the actuating system.

DETAILED DESCRIPTION OF THE EMBODIMENTS

Figure 1:
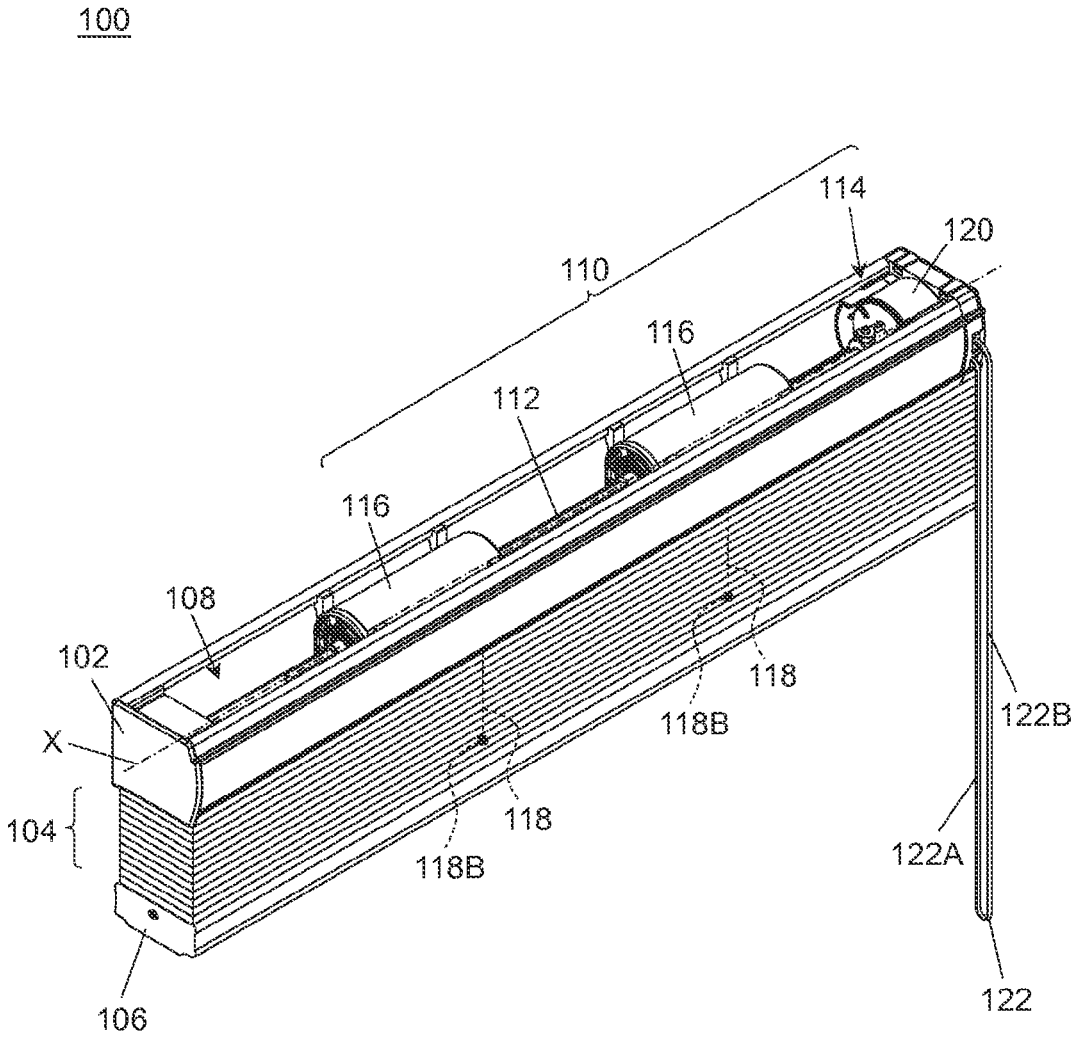
FIG. 1 is a perspective view illustrating an embodiment of a window shade.
Figure 2:
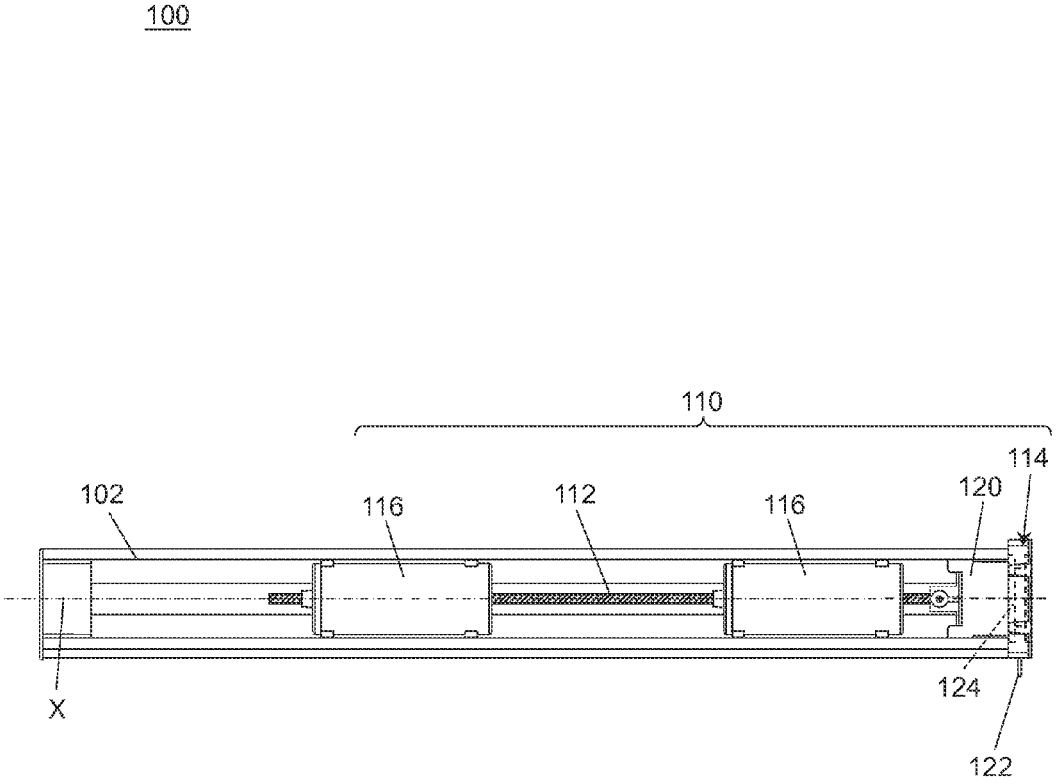
FIG. 2 is top view of the window shade shown in FIG. 1.
Figure 3:
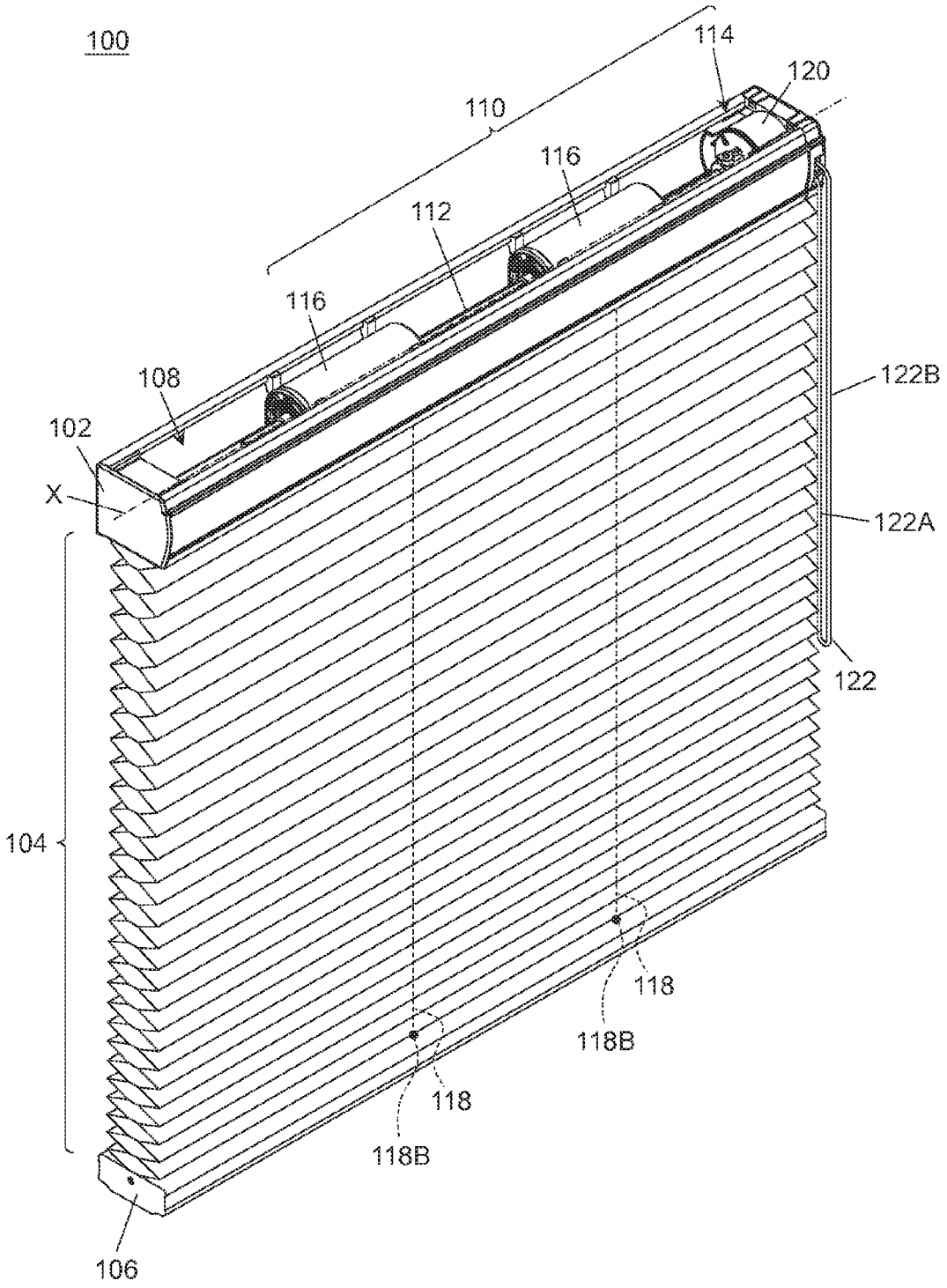
FIG. 3 is a schematic view illustrating the window shade of FIG. 1 in a fully lowered state.

FIG. 1 is a perspective view illustrating an embodiment of a window shade 100, FIG. 2 is a top view illustrating the window shade 100, and FIG. 3 is a schematic view illustrating the window shade 100 in a fully lowered state. The window shade 100 can includes a head rail 102, a shading structure 104, and a bottom part 106 disposed at a bottom of the shading structure 104. The head rail 102 may be of any types and shapes. The head rail 102 may be affixed at a top of a window frame, and the shading structure 104 and the bottom part 106 can be suspended from the head rail 102. Moreover, the head rail 102 can have an inner cavity 108 in which an actuating system 110 can be assembled for driving upward and downward displacements of the shading structure 104 and the bottom part 106.

The shading structure 104 can have any suitable constructions. For example, the shading structure 104 can include a honeycomb structure made from a cloth material (as shown), a Venetian blind construction, or a plurality of rails or slats extending vertically and parallel to one another.

The bottom part 106 is disposed at a bottom of the window shade 100, and is movable vertically relative to the head rail 102 to expand and collapse the shading structure 104. In one embodiment, the bottom part 106 may be formed as an elongated rail. However, any types of weighing structures may be suitable. In some embodiment, the bottom part 106 may also be formed by a lowermost portion of the shading structure 104.

The actuating system 110 arranged in the head rail 102 can include a transmission axle 112, a control module 114, one or more winding units 116, and one or more suspension members 118 respectively coupled with the winding units 116. The suspension members 118 can exemplary be suspension cords that extend vertically between the head rail 102 and the bottom part 106. Each of the suspension members 118 can have a first end portion 118A connected with one corresponding winding unit 116 (better shown in FIG. 5), and a second end portion 118B connected with the bottom part 106. The winding units 116 can respectively wind and unwind the suspension members 118 for raising and lowering the bottom part 106. The transmission axle 112 can extend lengthwise along the head rail 102 to define a longitudinal axis X, and the control module 114 and the winding units 116 can be coaxially connected with the transmission axle 112. The control module 114 can be operable to drive rotation of the transmission axle 112, which in turn drives concurrent rotation of the winding units 116 for winding or unwinding the suspension members 118.

The control module 114 can have any suitable construction operable to drive rotation of the transmission axle 112 in either direction for raising or lowering the bottom part 106. In one embodiment, the control module 114 can exemplary have a conventional construction comprised of a cord clutch 120, and a looped cord 122 connected with the cord clutch 120. The cord clutch 120 can typically have an inner pulley 124 (shown with phantom lines in FIG. 2) that is affixed with the transmission axle 112, and the looped cord 122 can wrap around the pulley 124 to define two segments 122A and 122B that extend outside the head rail 102 for manual operation. The segment 122A can be pulled downward to cause rotation of the pulley 124 and the transmission axle 112 in a first direction for raising the bottom part 106, and the other segment 122B can be pulled downward to cause rotation of the pulley 124 and the transmission axle 112 in a second direction for lowering the bottom part 106.

Figure 4:
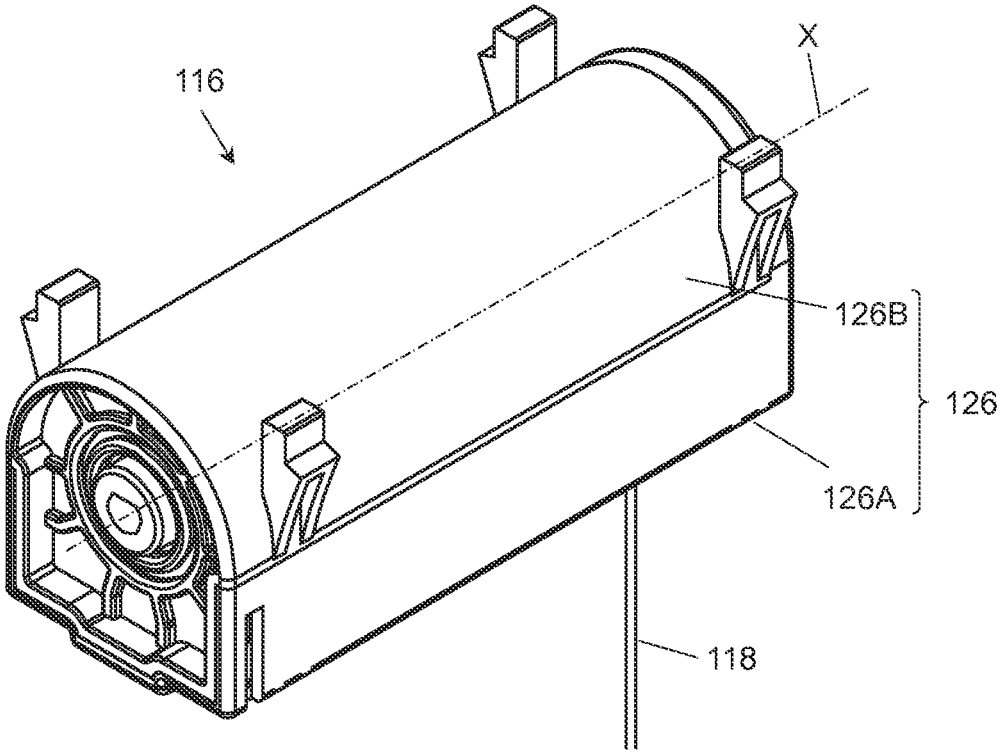
FIG. 4 is a schematic view illustrating a winding unit used in the window shade of FIG. 1.
Figure 5:
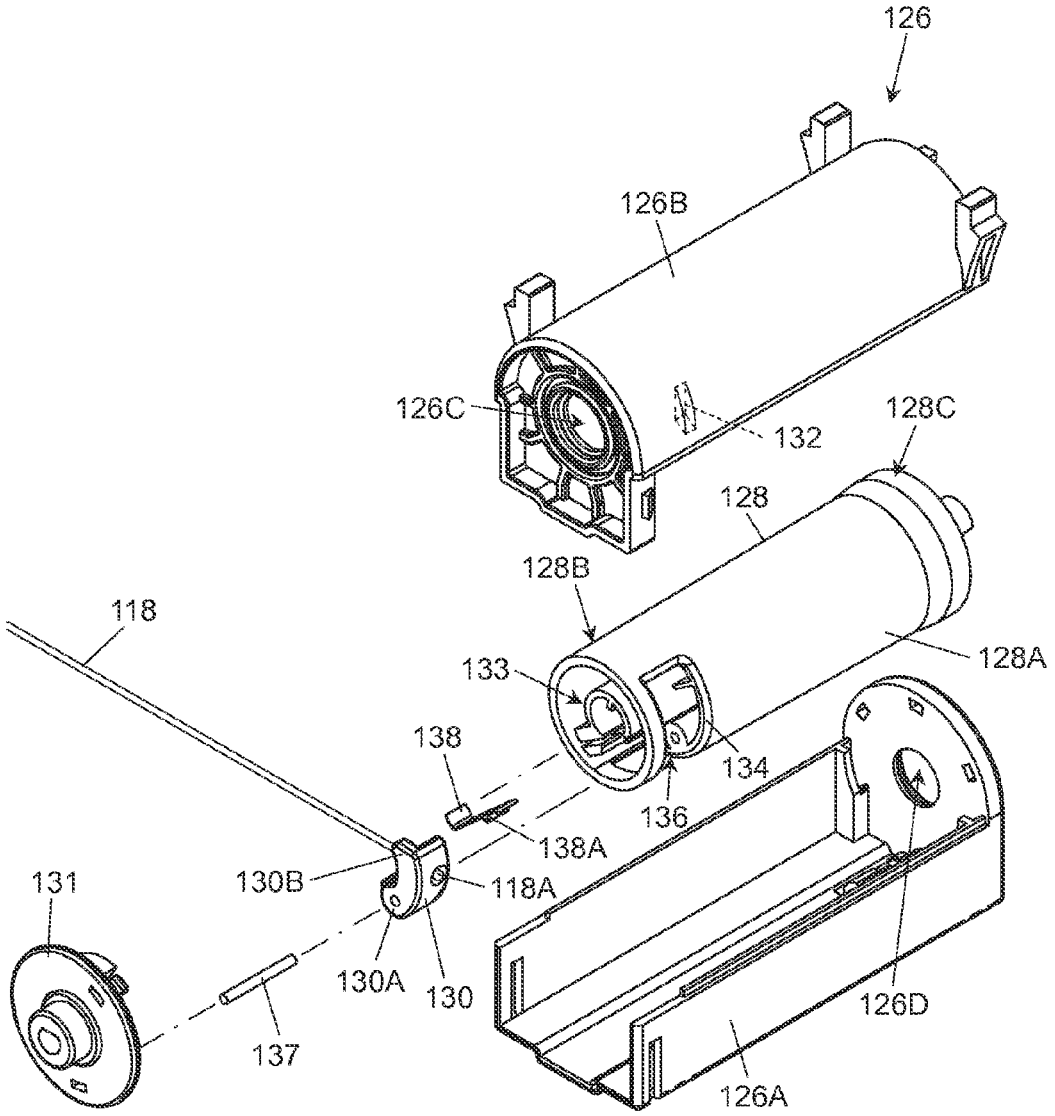
FIG. 5 is an exploded view of the winding unit shown in FIG. 4.
Figure 6:
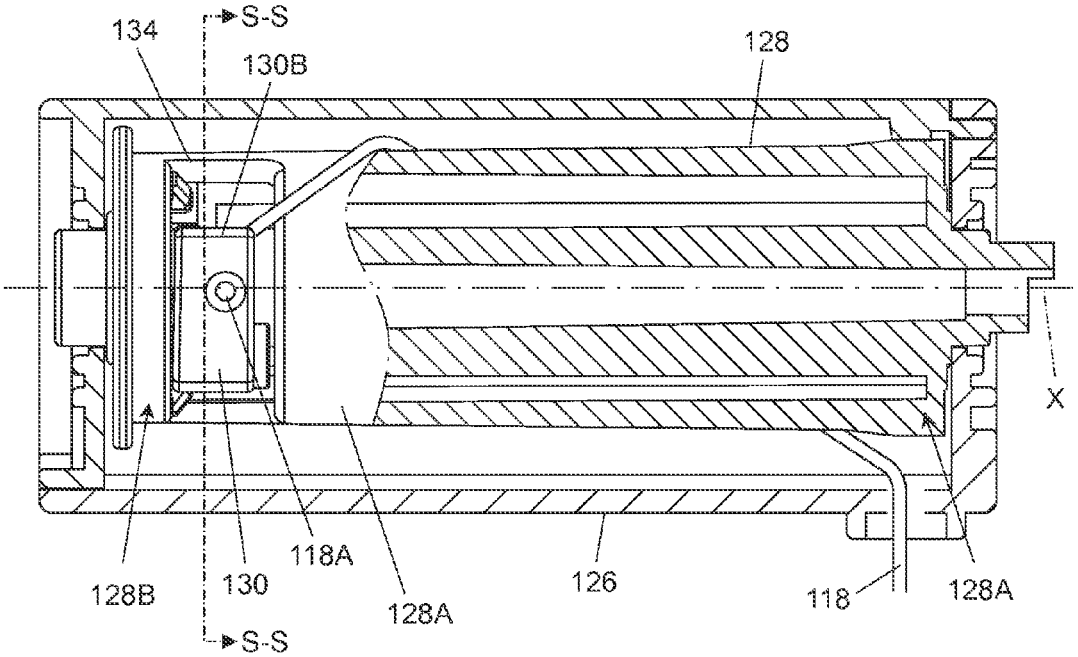
FIG. 6 is a partial cross-sectional view of the winding unit shown in FIG. 4.
Figure 7:
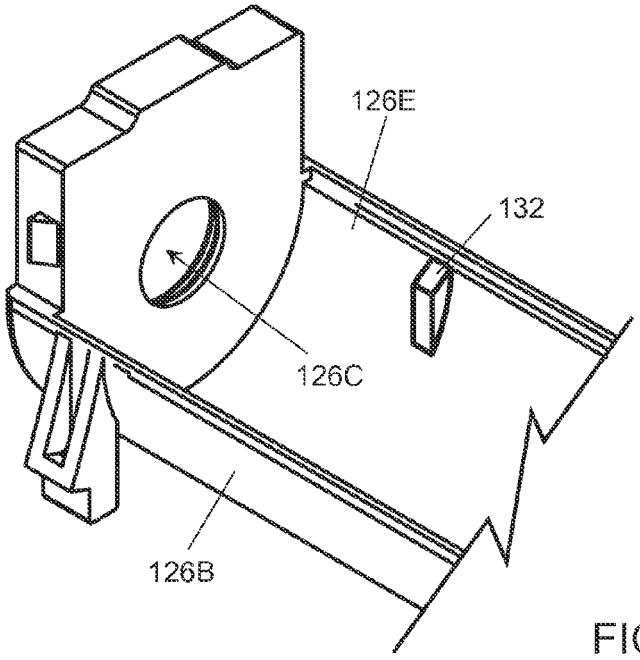
FIG. 7 is a schematic view illustrating a portion of a casing used in the construction of the winding unit shown in FIG. 4.
Figure 8:
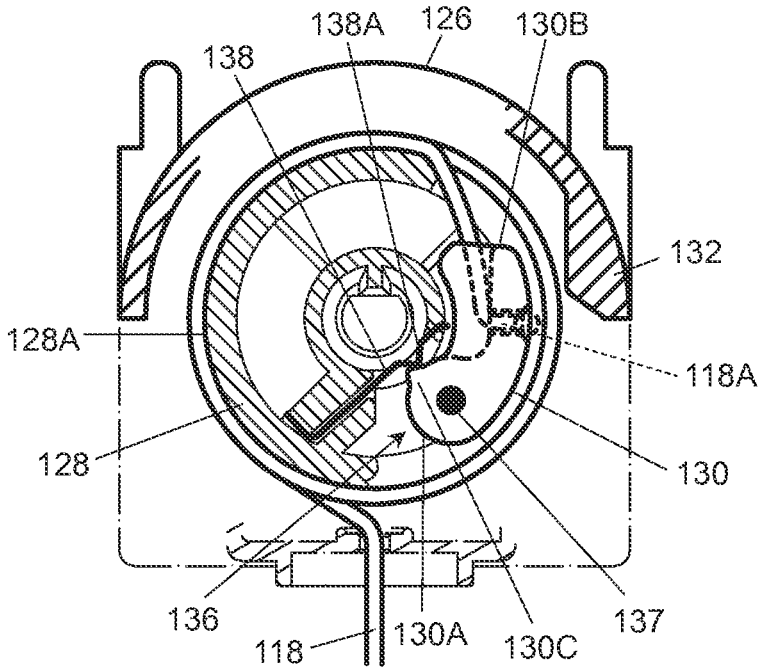
FIG. 8 is a partial cross-sectional view taken along the plane S-S shown in FIG. 6 illustrating the assembly of an impeding part in the winding unit.

FIG. 4 is a schematic view illustrating a winding unit 116, FIG. 5 is an exploded view of the winding unit 116, and FIG. 6 is a partial cross-sectional view of the winding unit 116. The winding unit 116 can include a casing 126, a rotary drum 128 and an impeding part 130. The casing 126 can be affixed with the head rail 102. In one embodiment, the casing 126 can be formed by the assembly of a lower body 126A and an upper body 126B, and can define an inner cavity in which the rotary drum 128 can be placed. Moreover, the casing 126 can have two opposite sidewalls through which openings 126C and 126D can be formed for passage of the transmission axle 112. The casing 126 can further include a fixed protrusion 132 projecting inward from an inner sidewall 126E of the casing 126. As shown in FIG. 7, the protrusion 132 can be exemplary formed with the upper body 126B of the casing 126.

The rotary drum 128 can be pivotally assembled in the casing 126, and can be rotationally coupled with the transmission axle 112. For example, the rotary drum 128 can be affixed with an end cap 131 which is pivotally connected with the casing 126, and the transmission axle 112 can be assembled through the end cap 131 and an inner central hole 133 of the rotary drum 128 so that the transmission axle 112 and the rotary drum 128 are rotationally locked with each other. The longitudinal axis X of the transmission axle 112 can thus define the rotation axis of the rotary drum 128. The rotary drum 128 can have an outer surface 128A that extends along the longitudinal axis X between two opposite end portions 128B and 128C of the rotary drum 128. The outer surface 128A can have an opening 134 near the end portion 128B that communicates with an inner cavity 136 of the rotary drum 128. The rotary drum 128 can be placed in the casing 126 such that the end portion 128B is located near the region of the casing 126 where the fixed protrusion 132 is arranged.

In conjunction with FIGS. 4-7, FIG. 8 is a schematic cross-sectional view taken along the plane S-S shown in FIG. 6 perpendicular to the longitudinal axis X for illustrating the assembly of the impeding part 130 in the winding unit 116. Referring to FIGS. 4-8, the impeding part 130 can be connected with the rotary drum 128 near the end portion 128B, and can be affixed with the end portion 118A of the suspension member 118. The impeding part 130 is assembled such that it is movable relative to the rotary drum 128 between a first position in which the impeding part 130 is retracted toward an interior of the rotary drum 128, and a second position in which the impeding part 130 projects substantially outward from the outer surface 128A of the rotary drum 128. In one embodiment, the impeding part 130 can be formed as an integral component, and can exemplary be pivotally connected with the rotary drum 128 about a shaft portion 137 arranged adjacent to the inner cavity 136. More specifically, the impeding part 130 can be formed to have a coupling portion 130A through which the shaft portion 137 is assembled, and terminate into a distal end 130B away from the coupling portion 130A. The shaft portion 137 is offset from the longitudinal axis X, and extends parallel to and along the longitudinal axis X. Accordingly, the impeding part 130 can pivot relative to the rotary drum 128 between the first position in which the distal end 130B can remain below or substantially leveled with the outer surface 128A of the rotary drum 128, and a second position in which the distal end 130B projects outward above the outer surface 128A.

The end portion 118A of the suspension member 118 is affixed with the impeding part 130 at a location offset from the shaft portion 137, and can move along with the impeding part 130 relative to the rotary drum 128. The suspension member 118 can wind on the outer surface 128A from the end portion 128B toward the opposite end portion 128C of the rotary drum 128.

Referring again to FIGS. 5 and 8, the rotary drum 128 can be further affixed with a retaining part 138. The retaining part 138 can be placed adjacent to the impeding part 130, and is operable to retain the impeding part 130 in the first position retracted toward the interior of the rotary drum 128. In one embodiment, the retaining part 138 can be formed as a plate formed with a protruding detent 138A, and the impeding part 130 can be affixed with a protrusion 130C (the protrusion 130C can be integrally formed with the impeding part 130) that is offset from the shaft portion 137 and located adjacent to the detent 138A. The impeding part 130 can be retained in the position retracted toward the interior of the rotary drum 128 by engagement of the detent 138A with the protrusion 130C.

In conjunction with FIGS. 1-8, further reference is made to FIGS. 9-17 to describe exemplary operation of the actuating system 110 of the window shade 100. The window shade 100 can be operated between a fully raised position in which the shading structure 104 is fully collapsed and the bottom part 106 lies close to the head rail 102 (as exemplary shown in FIG. 1), and a fully expanded position in which the bottom part 106 lies adjacent to a lowermost position vertically away from the head rail 102 (as exemplary shown in FIG. 3).

Figure 9:
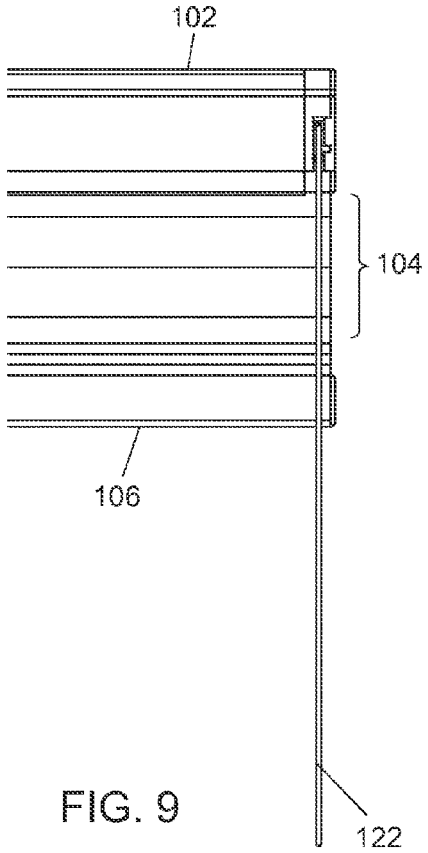
FIG. 9 is a schematic view illustrating the window shade in an intermediate position above a lowermost position.
Figure 10:
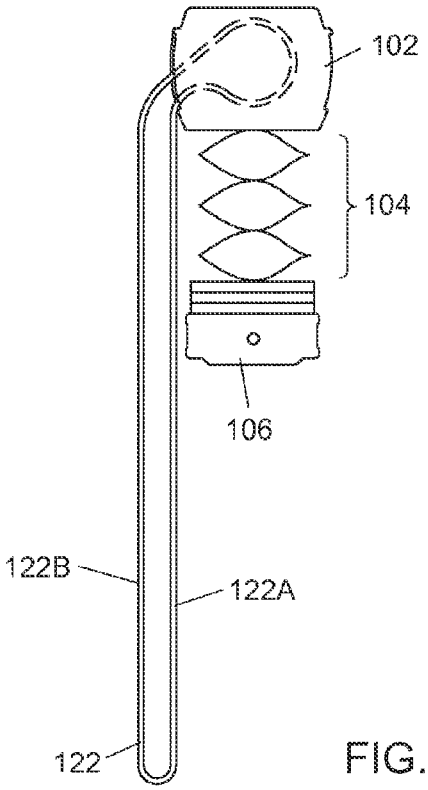
FIG. 10 is a side view of the window shade represented in FIG. 9.
Figure 11:
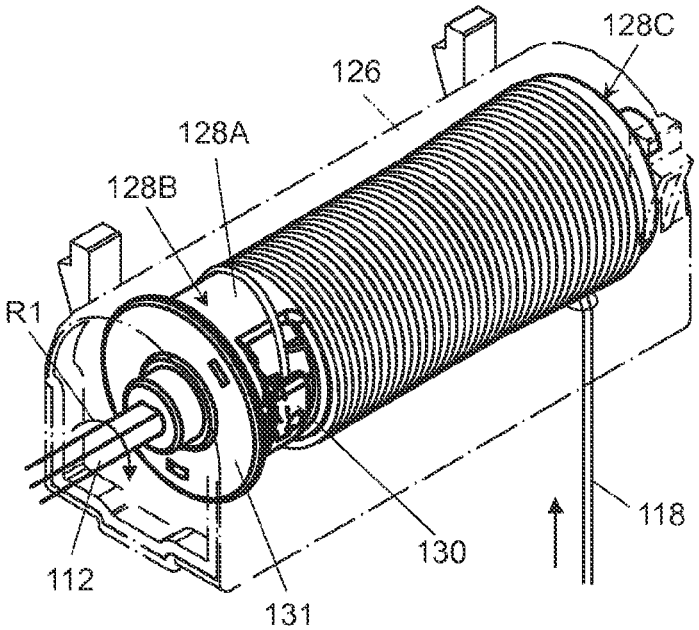
FIG. 11 is a schematic view illustrating exemplary operation of the winding unit for raising a bottom part of the window shade.
Figure 12:
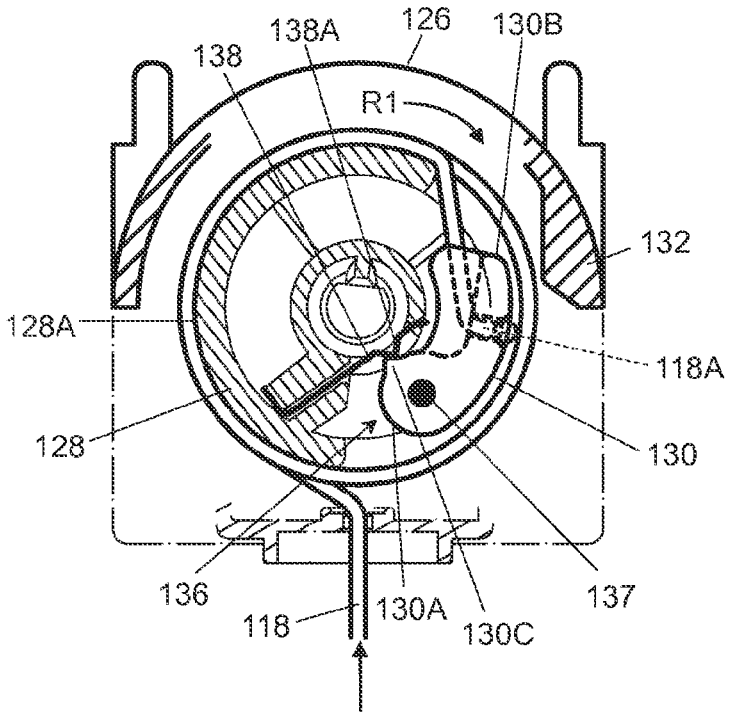
FIG. 12 is a cross-sectional view illustrating exemplary operation of the winding unit for raising the bottom part of the window shade.
Figure 13:
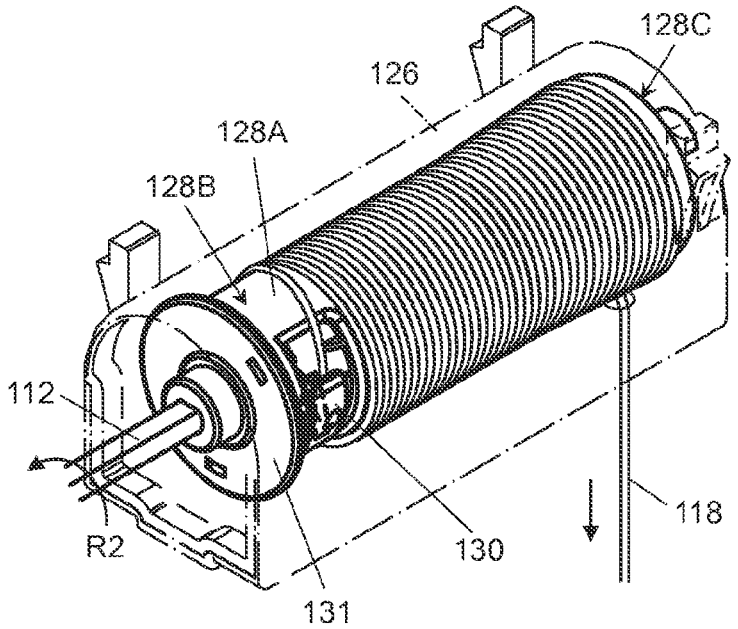
FIG. 13 is a schematic view illustrating exemplary operation of the winding unit for lowering the bottom part of the window shade.
Figure 14:
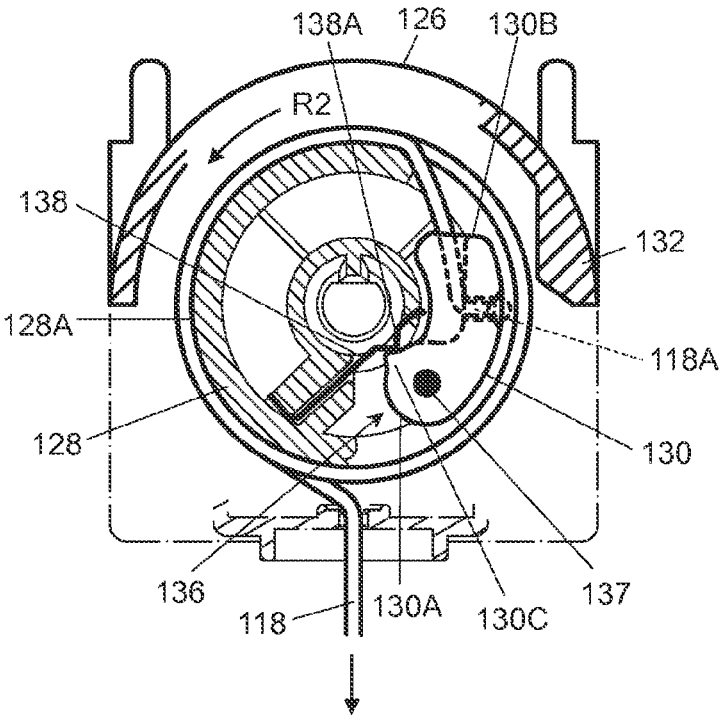
FIG. 14 is a cross-sectional view illustrating exemplary operation of the winding unit for lowering the bottom part of the window shade.

Referring to FIGS. 9 and 10, while the bottom part 106 is located at a position above the lowermost position, the looped cord 122 of the control module 114 can be operated to raise or lower the bottom part 106. For example, the segment 122A of the looped cord 122 can be pulled downward to drive rotation of the transmission axle 112 and the rotary drum 128 in a first direction R1 for raising the bottom part 106 (as shown in FIGS. 11 and 12), and the other segment 122B of the looped cord 122 can be pulled downward to drive rotation of the transmission axle 112 and the rotary drum 128 in a second direction R2 for lowering the bottom part 106 (as shown in FIGS. 13 and 14). As long as there is one or more turn of the suspension member 118 wound around the outer surface 128A, the protrusion 130C of the impeding part 130 can remain engaged with the detent 138A of the retaining part 138 to keep the impeding part 130 stationary relative to the rotary drum 128 in the position retracted in the inner cavity 136 of the rotary drum 128. In this position, the distal end 130B of the impeding part 130 can remain refracted below the outer surface 128A, the rotary drum 128 can rotate in either direction to wind or unwind the suspension member 118, and the impeding part 130 can move in unison with the rotary drum 128 past the fixed protrusion 132 of the casing 126.

Figure 15:
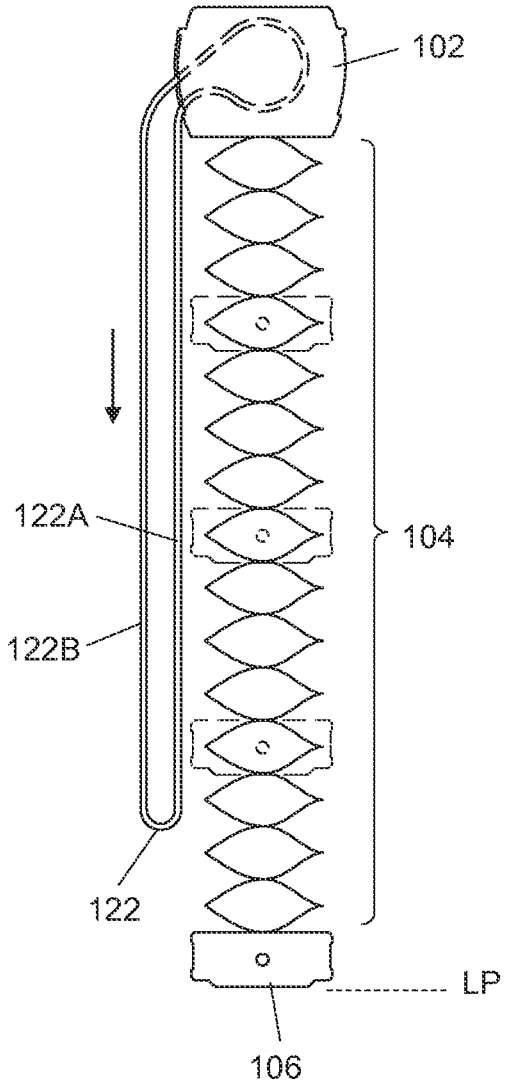
FIG. 15 is a schematic view illustrating exemplary actuation of the window shade to lower the bottom part to a lowermost position.
Figure 16:
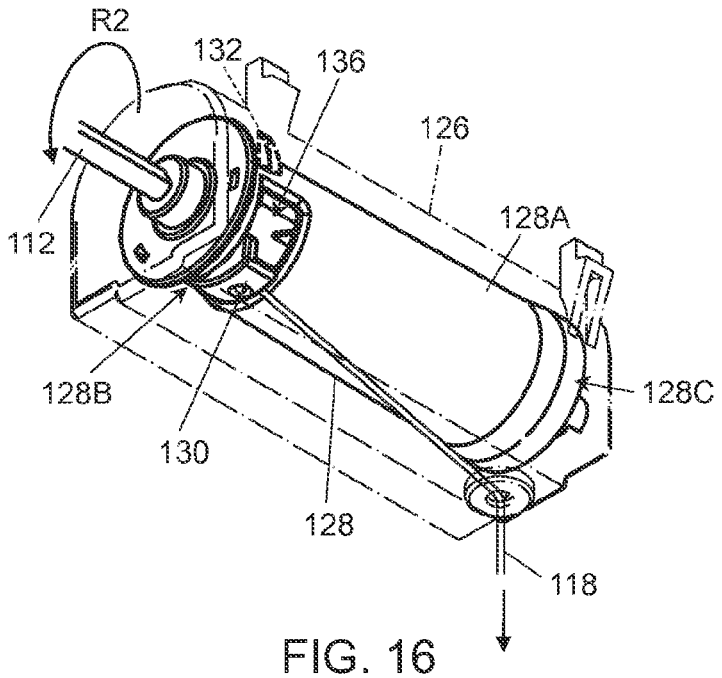
FIG. 16 is a schematic view illustrating a displacement of an impeding part assembled with the winding unit as the bottom part reaches the lowermost position.
Figure 17:
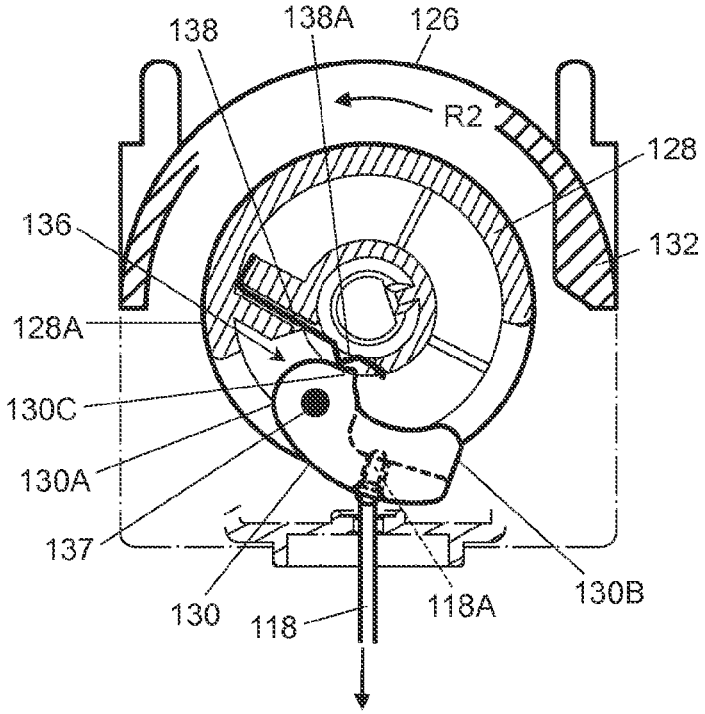
FIG. 17 is a partial cross-sectional view corresponding to the state shown in FIG. 16 illustrating the displacement of the impeding part as the bottom part reaches the lowermost position.
Figure 18:
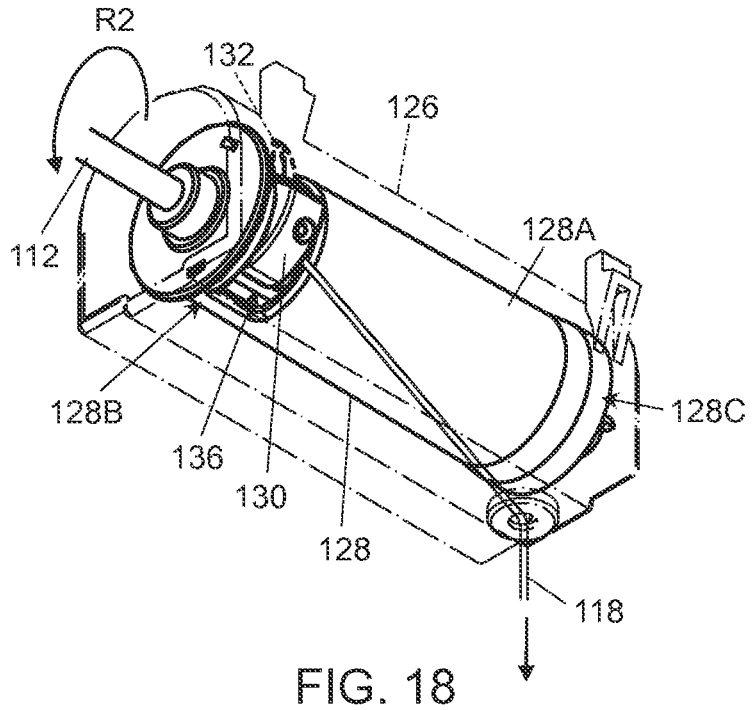
FIG. 18 is a schematic view illustrating an abutment of the impeding part against a fixed protrusion to stop further rotation of the winding unit when the bottom part moving downward is adjacent to the lowermost position.
Figure 19:
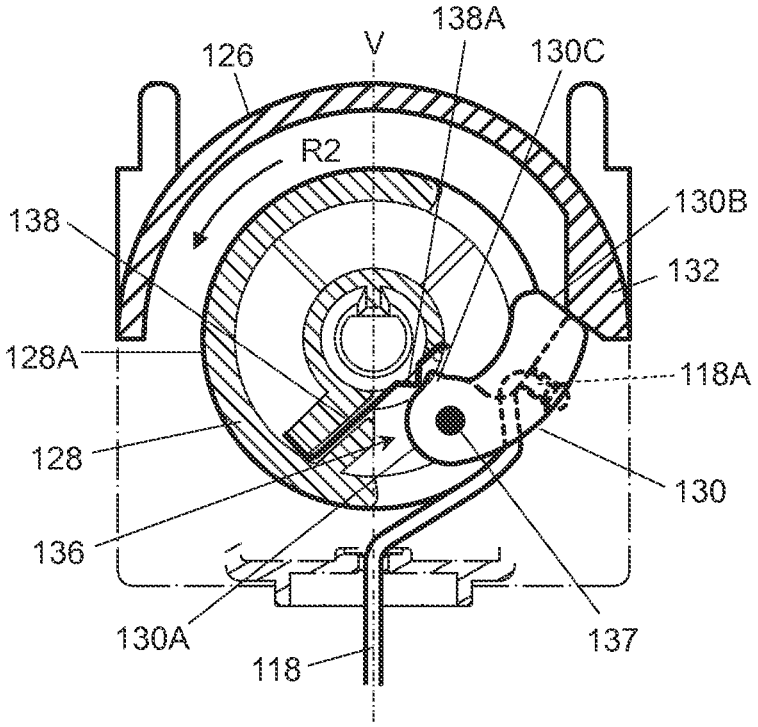
FIG. 19 is a partial cross-sectional view corresponding to the state shown in FIG. 18 illustrating the abutment of the impeding part against the fixed protrusion.

Referring to FIGS. 15-19, when the bottom part 106 moving downward reaches the lowermost position LP shown in FIG. 15, the suspension member 118 can be substantially or entirely unwound from and out of contact with the outer surface 128A of the rotary drum 128, and the outer surface 128A no longer bears the downward weight load exerted by the bottom part 106. As a result, the downward weight load exerted by the bottom part 106 can be transmitted through the suspension member 118 to the impeding part 130. The impeding part 130 is oriented such that the downward weight load exerted by the bottom part 106 can pull the impeding part 130 to overcome the obstruction of the detent 138A of the retaining part 138 (for example, by elastic deformation) and pivot relative to the rotary drum 128 for projecting outward from the outer surface 128A. The distal end 130B of the impeding part 130 can thereby displace from the first position retracted toward the interior of the rotary drum 128 to the second position projecting outward from the outer surface 128A of the rotary drum 128, as shown in FIGS. 16 and 17. As the rotary drum 128 rotates and drives displacement of the impeding part 130 in the same direction R2, the distal end 130B projecting outward can then come in abutment against the fixed protrusion 132 of the casing 126, which is shown in FIGS. 18 and 19. As a result, further rotation of the rotary drum 128 and the transmission axle 112 in the direction R2 can be stopped, which blocks further downward actuation of the segment 122B of the looped cord 122.

With the aforementioned construction, the engagement of the impeding part 130 with the fixed protrusion 132 of the casing 126 can stop the bottom part 106 adjacent to its lowermost position LP. The impeding part 130, the retaining part 138 and the fixed protrusion 132 can thereby form a limiting mechanism to define the number of revolutions of the rotary drum 128 for lowering the bottom part 106 from the head rail 102 to the preset lowermost position LP. Accordingly, the actuating system 110 can operate in a consistent manner, i.e., downward pulling on the segment 122A of the looped cord 122 always drives raising of the bottom part 106, and downward pulling on the segment 122B of the looped cord 122 always drives lowering of the bottom part 106. For ensuring that the impeding part 130 can abut against the fixed protrusion 132 after it is pulled outward the rotary drum 128, the fixed protrusion 132 can be arranged at a location that is adjacently offset from a vertical axis V intersecting the rotation axis of the rotary drum 128 (as shown), or on the vertical axis V and below the rotary drum 128.

Figure 20:
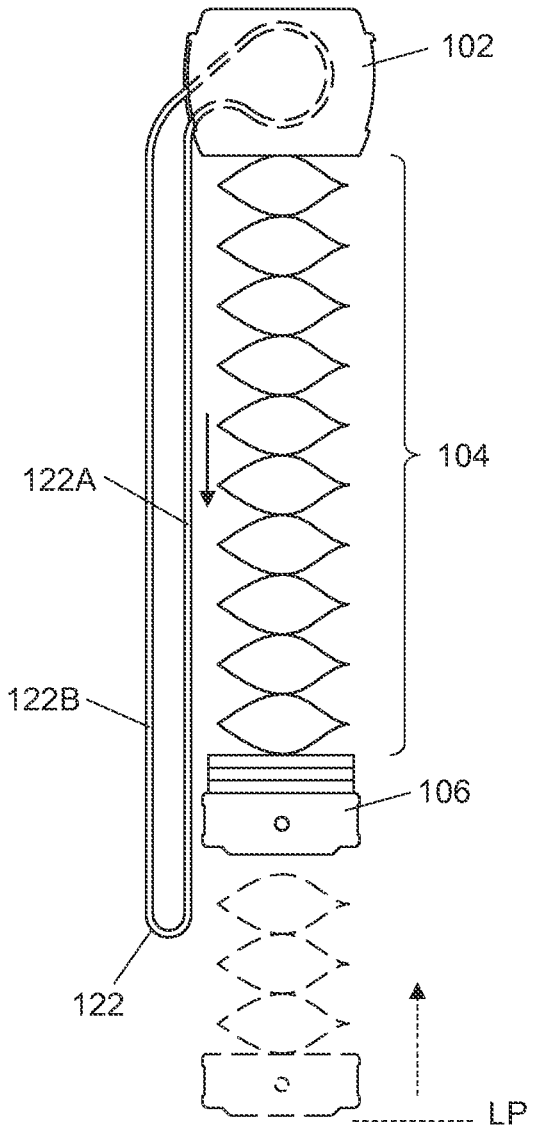
FIG. 20 is a schematic view illustrating exemplary operation of the window shade to raise the bottom part from the lowermost position.
Figure 21:
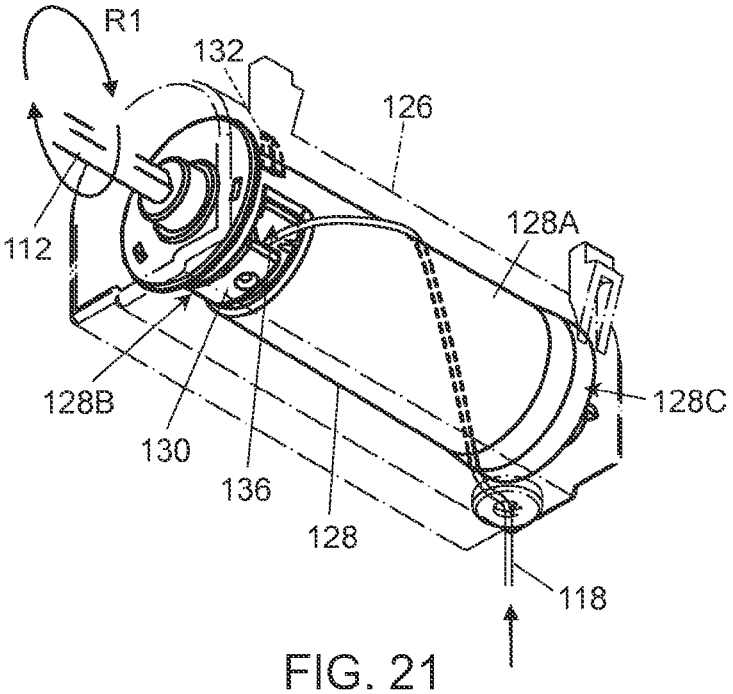
FIG. 21 is a schematic view illustrating a rotation of the winding unit for raising the bottom part from the lowermost position.
Figure 22:
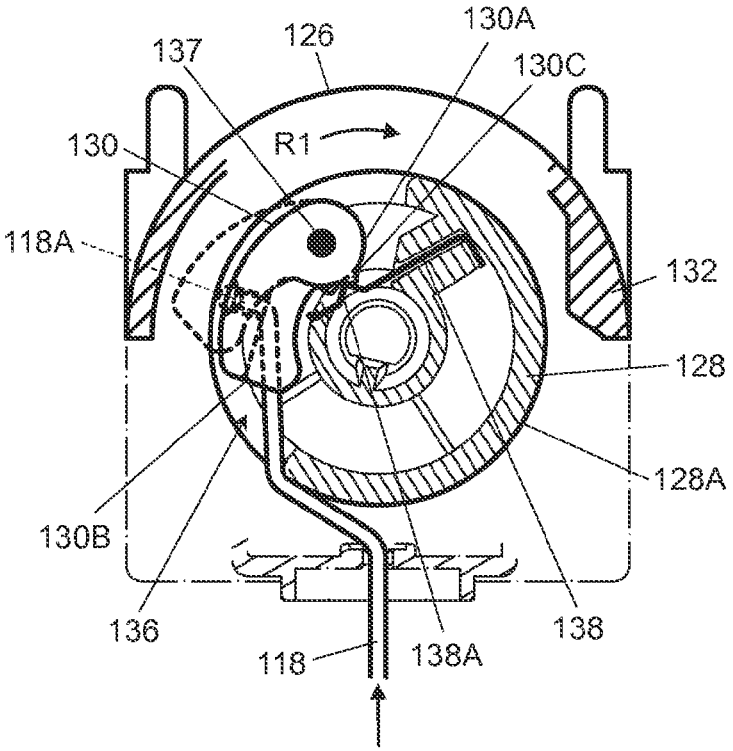
FIG. 22 is a partial cross-sectional view illustrating the rotation of the winding unit for raising the bottom part from the lowermost position.

Referring to FIGS. 20-22, for raising the bottom part 106 from the lowermost position LP, the segment 122A of the looped cord 122 can be pulled downward to drive rotation of the transmission axle 112 and the rotary drum 128 in the direction R1. This rotation of the rotary drum 128 can drive the impeding part 130 to disengage from the fixed protrusion 132, and change the orientation of the impeding part 130 with respect to the vertical direction of the weight load exerted by the bottom part 106. As a result, the downward weight load exerted by the bottom part 106 can pull the impeding part 130 to pivot relative to the rotary drum 128 toward the inner cavity 136. As a result, the protrusion 130C of the impeding part 130 can be urged to engage with the detent 138A of the retaining part 138 (for example by elastic deformation), so that the impeding part 130 can be kept stationary relative to the rotary drum 128 in the position refracted in the inner cavity 136 of the rotary drum 128. In one embodiment, the fixed protrusion 132 may also be arranged such that it can push the impeding part 130 toward the inner cavity 136 as the rotary drum 128 rotates one turn from the fully expanded position for raising the bottom part 106.

It will be appreciated that the limiting mechanism as described herein may be implemented with any types of window shades using rotary drums for winding and unwinding suspension members, such as honeycomb shades, roller shades, Venetian blinds, and the like.

Figure 23:
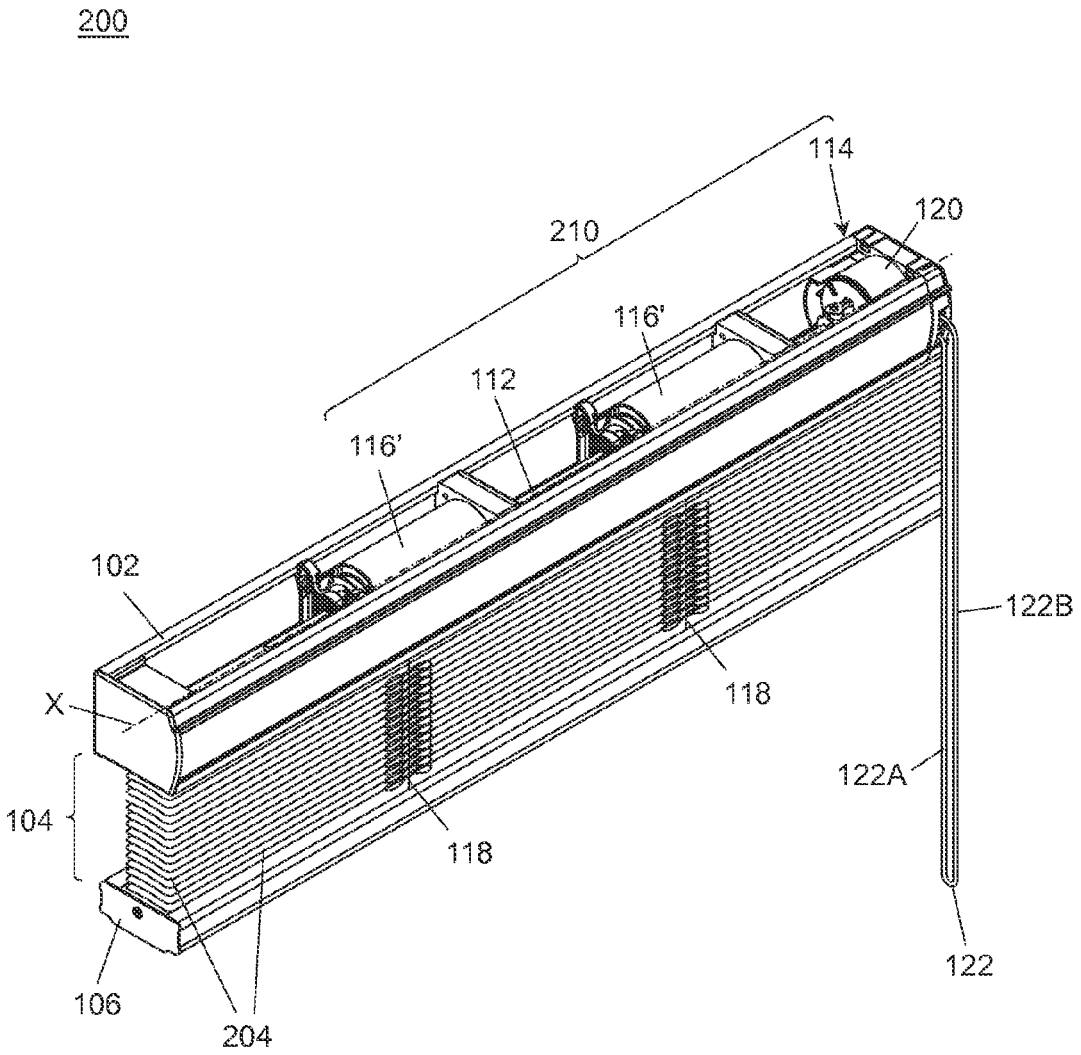
FIG. 23 is a schematic view illustrating another embodiment of a window shade.

FIG. 23 is a schematic view illustrating a variant embodiment of an actuating system 210 provided in a window shade 200. Like previously described, the window shade 100 can includes a head rail 102, a shading structure 104 comprised of a plurality of slats 204, and a bottom part 106 disposed at a bottom of the shading structure 104. The slats 204 and the bottom part 106 can be suspended from the head rail 102, and the bottom part 106 is movable vertically relative to the head rail 102 to expand and collapse the slats 204 between the head rail 102 and the bottom part 106.

The actuating system 210 can include the transmission axle 112, the control module 114, one or more winding units 116', and one or more suspension members 118 respectively coupled with the winding units 116'. Like previously described, the control module 114 can be operable to drive rotation of the transmission axle 112 in either direction for raising or lowering the bottom part 106. Moreover, the winding unit 116' is operable to wind and unwind the suspension member 118 for raising and lowering the bottom part 106.

Figure 24:
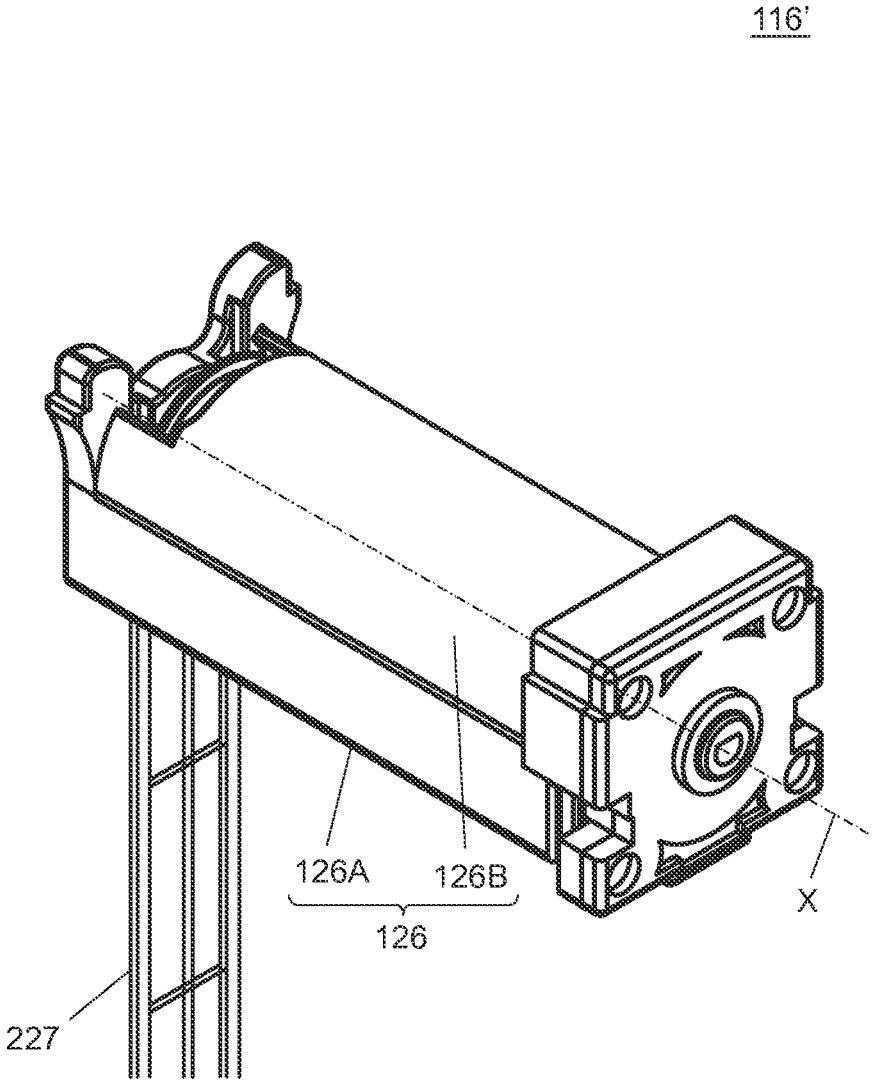
FIG. 24 is a schematic view illustrating a winding unit used in the window shade shown in FIG. 23.
Figure 25:
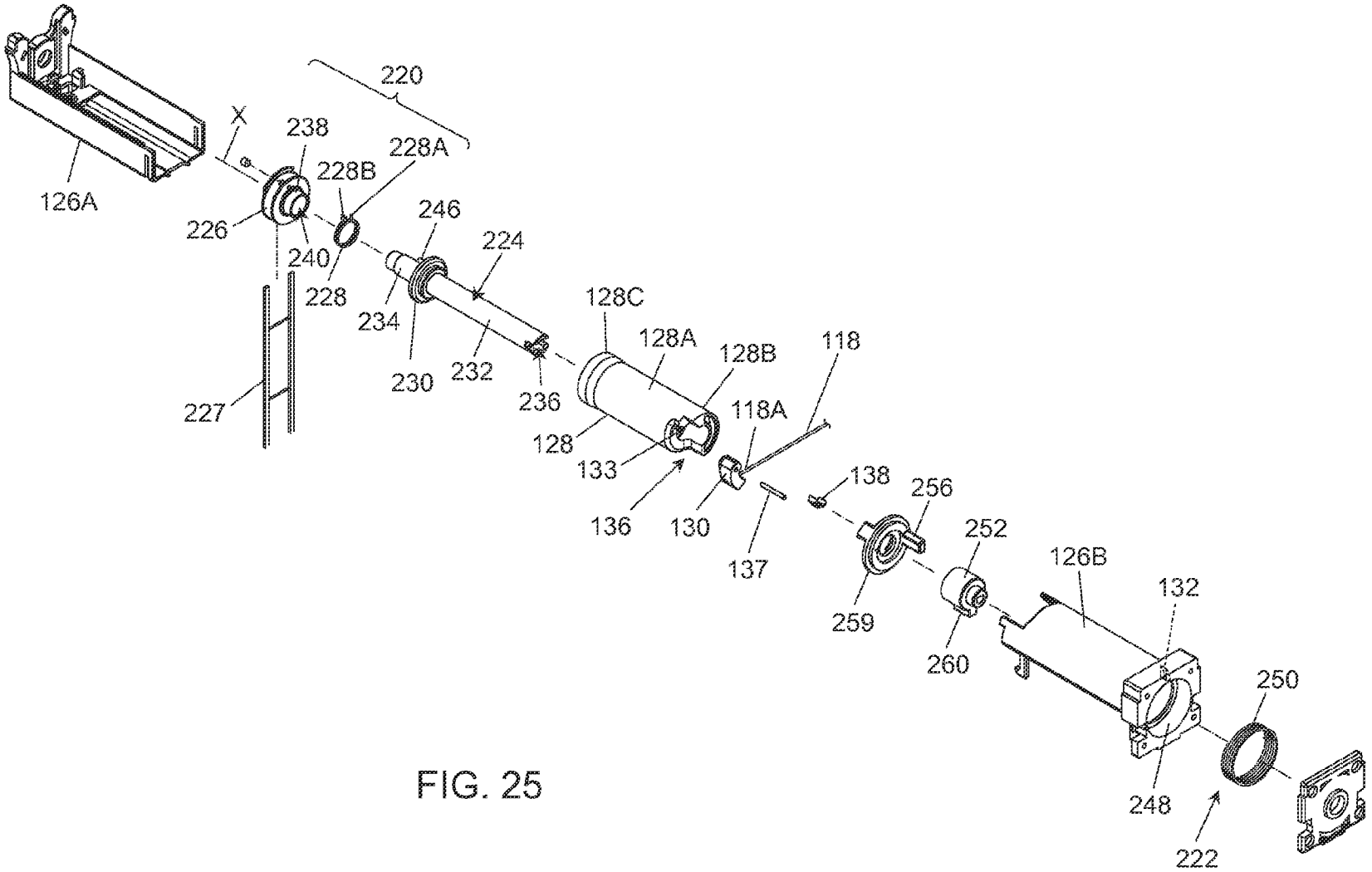
FIG. 25 is an exploded view of the winding unit shown in FIG. 24.
Figure 26:
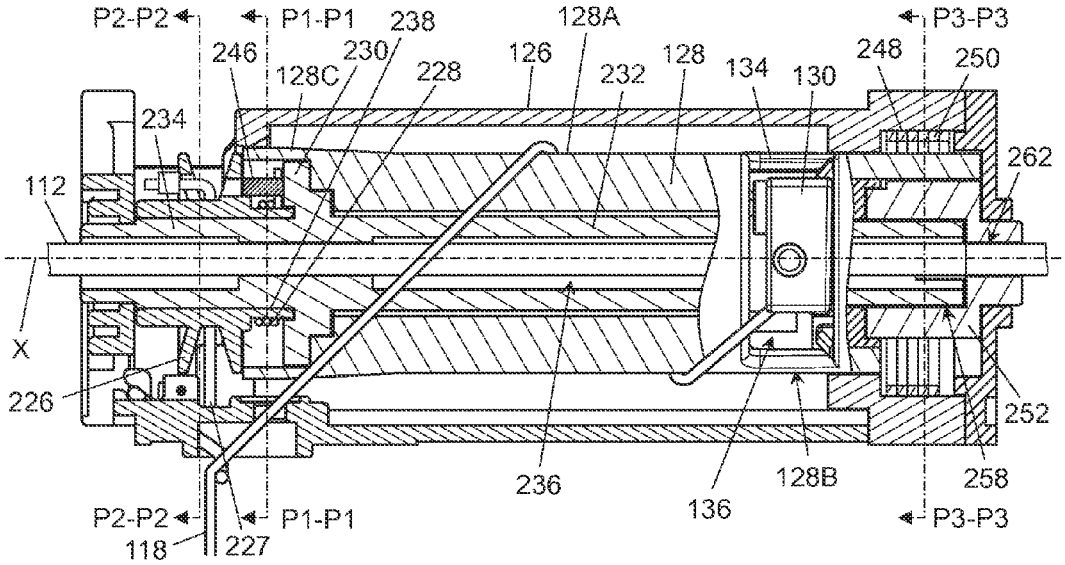
FIG. 26 is a cross-sectional view of the winding unit shown in FIG. 24 taken along a longitudinal axis.

FIG. 24 is a schematic view illustrating one winding unit 116', and FIGS. 25 and 26 are respectively exploded and cross-sectional views of one winding unit 116'. Like previously described, the winding unit 116' can include the casing 126, the rotary drum 128 and the impeding part 130. The rotary drum 128 can rotate along with the transmission axle 112 to wind one corresponding suspension member 118 for raising the bottom part 106, and to unwind the suspension member 118 for lowering the bottom part 106. Moreover, the rotary drum 128 can also be assembled with the impeding part 130 and the retaining part 138 that are arranged near the end portion 128B. The construction and operation of the impeding part 130 and the retaining part 138 can be similar to the aforementioned description. The retaining part 138 can hold the impeding part 130 in a retracted position so that the impeding part 130 is movable with the rotary drum 128 past the fixed protrusion 132 of the casing 126 to wind or unwind the suspension member 118. The impeding part 138 can be driven by the weight load of the bottom part 106 to displace from the retracted position to the deployed position at which it can engage with the fixed protrusion 132 of the casing 126 to stop the bottom part 106 adjacent to its lowermost position.

Referring to FIGS. 23-26, the actuating system 210 can further include a tilting mechanism 220 and a clutch unit 222 that are respectively integrated with the winding unit 116'. The tilting mechanism 220 can be operable to adjust the inclination of the slats 204, and the clutch unit 222 can operate to hold the bottom part 106 at a desired height.

In conjunction with FIGS. 25 and 26, FIGS. 27 and 28 are schematic cross-sectional views taken in two planes P1-P1 and P2-P2 perpendicular to the longitudinal axis X as shown in FIG. 26, which illustrate the assembly of the tilting mechanism 220. Referring to FIGS. 25-28, the tilting mechanism 220 can include a coupling part 224, a pulley 226, a ladder cord 227 and a torsion spring 228, all of which can be assembled with the casing 126. The coupling part 224 can include a collar portion 230, and two axial sleeve segments 232 and 234 affixed with the collar portion 230. The collar portion 230 can project radially with respect to the two sleeve segments 232 and 234, and the sleeve segments 232 and 234 can have elongated shapes that respectively extend axially at two opposite sides of the collar portion 230. A hole 236 can be formed through the collar portion 230 and the sleeve segments 232 and 234. The coupling part 224 can be pivotally arranged through the casing 126, the sleeve segment 232 being arranged through the inner central hole 133 of the rotary drum 128, and the transmission axle 112 being assembled through the hole 236 and extending through the sleeve segments 232 and 234 and the collar portion 230. The hole 236 of the coupling part 224 is configured to fit with the transmission axle 112, and the diameter of the inner central hole 133 of the rotary drum 128 is greater than the cross-section of the sleeve segment 224. Accordingly, the coupling part 224 can be rotationally coupled with the transmission axle 112, whereas relative rotation is allowed between the rotary drum 128 and the coupling part 224.

The pulley 226 can be affixed with a sleeve portion 238 that projects axially at a side of the pulley 226 facing the collar portion 230 of the coupling part 224. In one embodiment, the pulley 226 and the sleeve portion 238 can be integral in a single piece. The pulley 226 and the sleeve portion 238 can be assembled around the sleeve segment 234 and the transmission axle 112 at a location adjacent to the end portion 128A of the rotary drum 128, the sleeve segment 234 passing through a central hole 240 of the pulley 226. The assembly of the sleeve segment 234 through the pulley 226 can allow rotation of the coupling part 224 relative to the pulley 226 about the longitudinal axis X, and the pulley 226 can rotate independently from the rotary drum 128.

Figure 28:
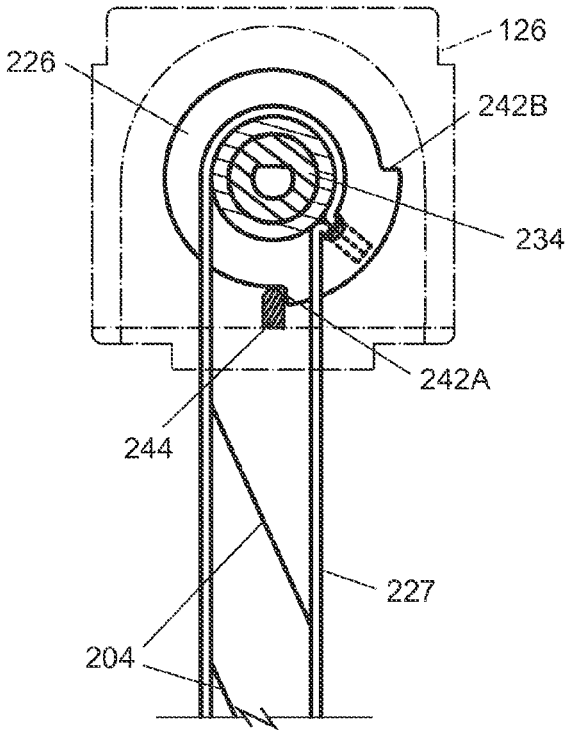
FIGS. 28 and 29 are partial cross-sectional views taken in the plane P2-P2 shown in FIG. 26 illustrating exemplary operations of the tilting mechanism.
Figure 29:
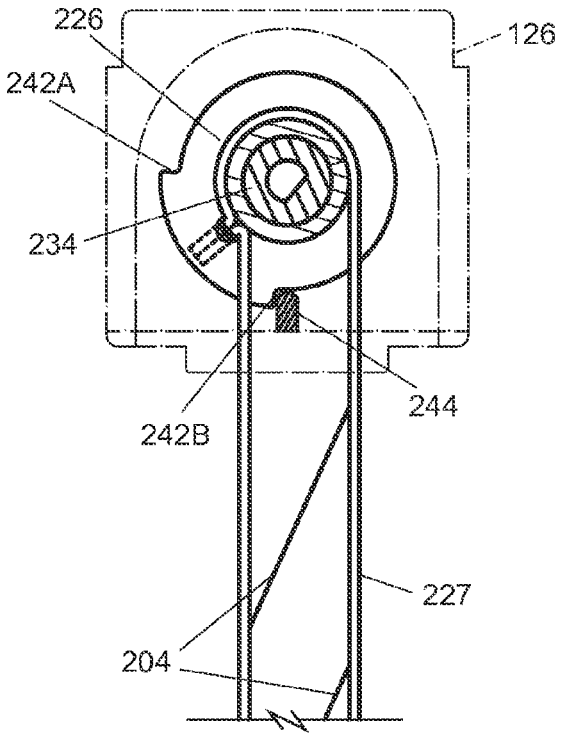

As shown in FIG. 28, the pulley 226 can also include two flange surfaces 242A and 242B that are angularly apart from each other relative to the longitudinal axis X. The pulley 226 can have a range of rotational displacement that is delimited between a first angular position where the flange surface 242A contacts with a stop rib 244 affixed with the casing 126, and a second angular position where the flange surface 242B contacts with the stop rib 244. The abutment of the flange surface 242A against the stop rib 244 can define a maximum tilt angle of the slats 204 in a first direction (as shown in FIG. 28), and the abutment of the flange surface 242B against the stop rib 244 can define a maximum tilt angle of the slats 204 in a second direction opposite to the first direction (as shown in FIG. 29).

The ladder cord 227 can be connected with the pulley 226, and can be secured with the slats 204. Rotation of the pulley 226 can drive vertical displacement of the ladder cord 227 so as to tilt the slats 204.

Figure 27:
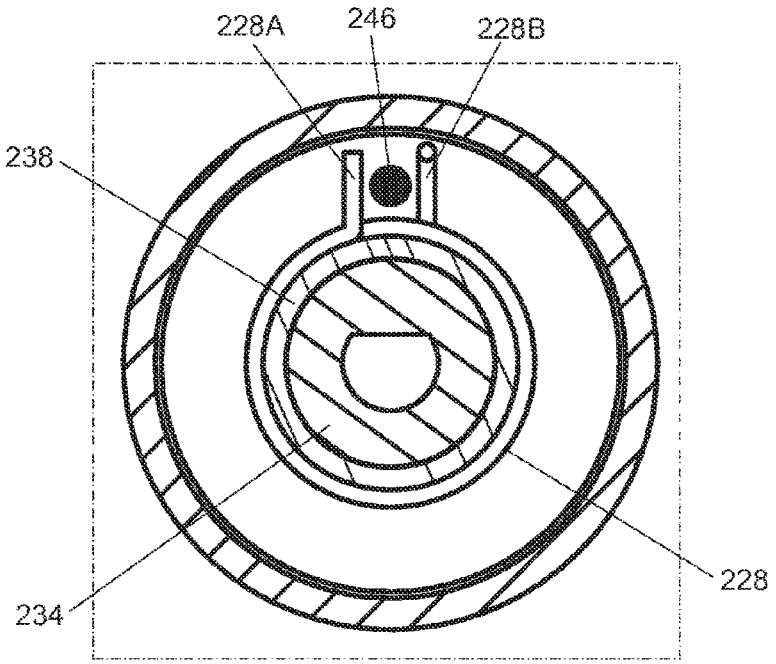
FIG. 27 is a cross-sectional view taken in the plane P1-P1 shown in FIG. 26 illustrating a portion of a tilting mechanism integrated with the winding unit.

Referring to FIGS. 25-27, the torsion spring 228 can have two spaced-apart prongs 228A and 228B, and can be assembled in frictional contact with the sleeve portion 238 of the pulley 226. The collar portion 230 of the coupling part 224 can have a protruding post 246 that is offset from the longitudinal axis X and is placed in a gap delimited between the two prongs 228A and 228B of the torsion spring 228.

A rotational displacement of the transmission axle 112 can drive the coupling part 224 to rotate and cause the post 246 to push against either of the prongs 228A and 228B, which causes the torsion spring 228 and the pulley 226 to rotate in unison relative to the rotary drum 128 owing to the frictional contact between the torsion spring 228 and the sleeve portion 238 of the pulley 226. Moreover, the abutment of the stop rib 244 against any of the flange surfaces 242A and 242B can block rotation of the pulley 226, so that further rotation of the transmission axle 112 and the coupling part 224 can cause the torsion spring 228 to loosen its grip on the sleeve portion 238, whereby the transmission axle 112, the coupling part 224 and the rotary drum 128 can continue to rotate for winding or unwinding the suspension member 118 while the pulley 226 remains stationary.

Referring again to FIGS. 25 and 26, the clutch unit 222 can have a locking state in which it frictionally engages with an inner sidewall 248 of the casing 126 to prevent rotation of the rotary drum 128 for unwinding the suspension member 118, and an unlocking state in which rotation of the rotary drum 128 is allowed for winding and unwinding the suspension member 118. Moreover, the clutch unit 222 can be triggered by a rotation of the transmission axle 112 in either direction to switch from the locking state to the unlocking state.

Figure 30:
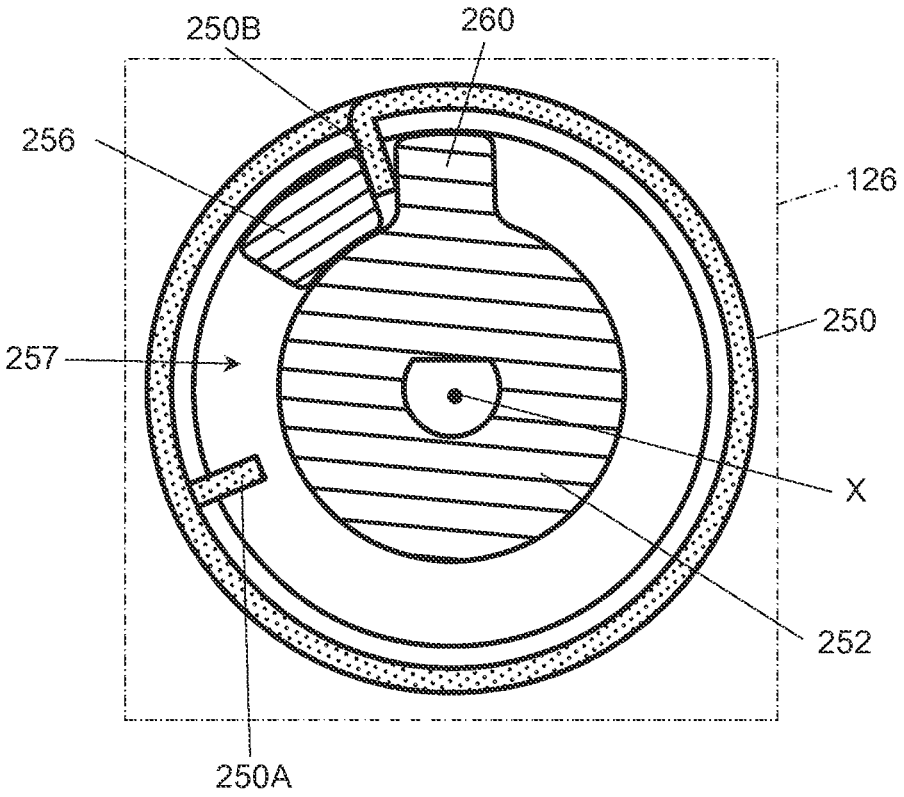
FIG. 30 is a cross-sectional view taken in the plane P3-P3 shown in FIG. 26 illustrating a portion of a clutch unit integrated with the winding unit shown in FIG. 24.

The clutch unit 222 can be assembled in the casing 126 adjacent to the end portion 128B of the rotary drum 128. More specifically, the clutch unit 220 can include a torsion spring 250 and an actuating part 252. FIG. 30 is a schematic cross-sectional view taken in the plane P3-P3 perpendicular to the longitudinal axis X as shown in FIG. 26, which illustrates the assembly of the torsion spring 250 in the clutch unit 222. The torsion spring 250 can have two spaced-apart prongs 250A and 250B, and can be assembled in frictional contact with the inner sidewall 248 of the casing 126. The torsion spring 250 can be placed such that a flange 256 affixed with the rotary drum 128 is positioned in a gap 257 between the two prongs 250A and 250B. The flange 256 is offset from the longitudinal axis X, and the gap 257 has a width that is equal or larger than a width of the flange 256. In one embodiment, the flange 256 may be exemplary formed on a ring 259 that is affixed with the rotary drum 128 adjacent to the end portion 128B. In another embodiment, the flange 256 may be formed integrally with the rotary drum 128. The flange 256 can move with the rotary drum 128 relative to the torsion spring 250 to push against any of the two prongs 250A and 250B, which can urge the torsion spring 250 to enlarge and frictionally contact with the inner sidewall 248 of the casing 126 so as to prevent rotation of the rotary drum 128 for unwinding the suspension member 118.

The actuating part 252 can be assembled through the torsion spring 250. The actuating part 252 can have a central cavity 258, and a protrusion 260 affixed with and protruding radially from an outer surface of the actuating part 252. A portion of the sleeve segment 232 extending outward the rotary drum 128 near its end portion 128B can be received in the central cavity 258 of the actuating part 252. The sleeve segment 232 can thereby aid to support of the actuating part 252. The actuating part 252 can further include a hole 262, and the transmission axle 112 can extend through the interior of the rotary drum 128 and can be assembled through the hole 262 to rotationally couple the actuating part 252 with the transmission axle 112. The actuating part 252 can be drivable in rotation by the transmission axle 112 so that the protrusion 260 can push against any of the two prongs 250A and 250B to loosen the frictional contact of the torsion spring 250 with the inner sidewall 248 of the casing 126, whereby a rotation of the transmission axle 112 can be transmitted via the actuating part 252 and the torsion spring 250 to the rotary drum 128.

Figure 31:
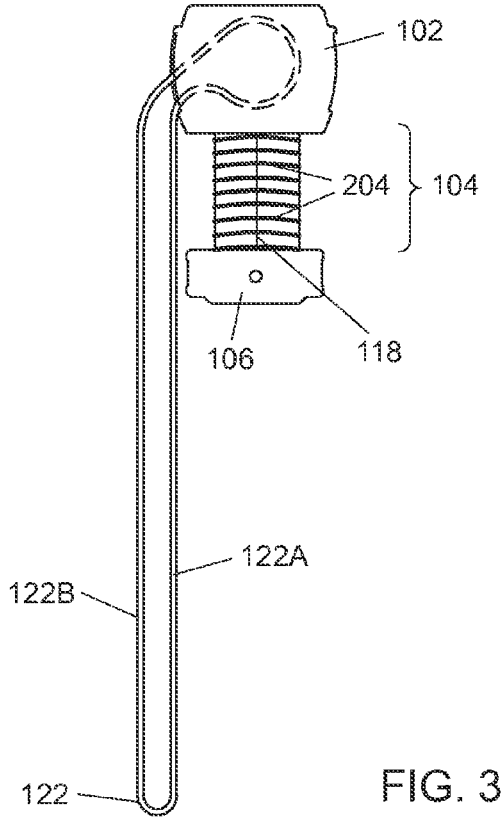
FIG. 31 is a schematic view illustrating the window shade of FIG. 23 in an intermediate position.
Figure 32:
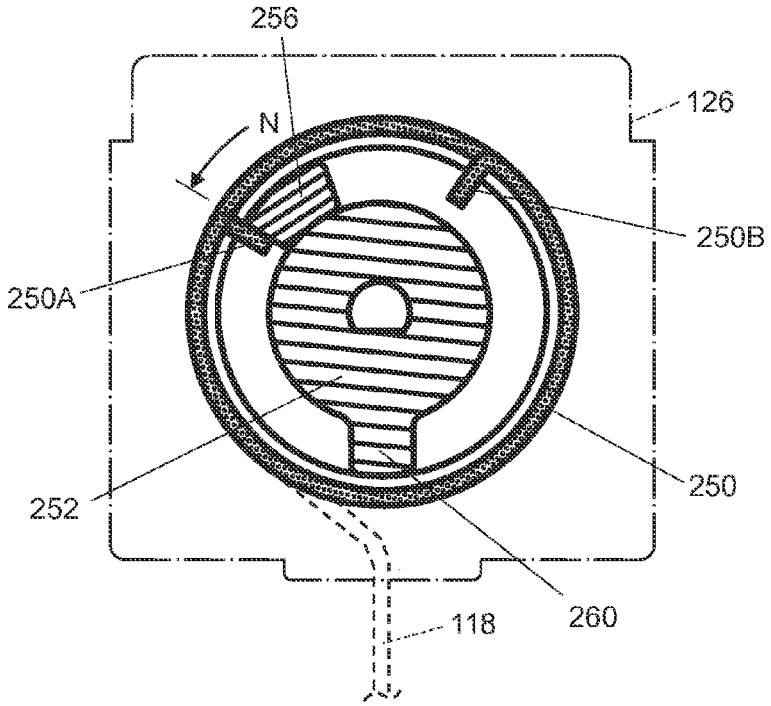
FIG. 32 is a schematic view illustrating a portion of the clutch unit in a state corresponding to the position of the window shade shown in FIG. 31.

In conjunction with FIGS. 23-30, further reference is made to FIGS. 31-42 to describe exemplary operation of the actuating system 210. FIGS. 31 and 32 illustrate a configuration in which the control module 114 remains stationary and no pulling action is applied on the looped cord 122. A vertical weight exerted by the bottom part 106 on the suspension member 118 can result in the application of a torque N on the rotary drum 128, which rotationally urges the rotary drum 128 in a direction that causes the flange 256 to push against the prong 250A of the torsion spring 250. This pushing force is in a direction that tends to push the prong 250A away from the prong 250B (i.e., in a direction widening the gap 257), which urges the torsion spring 250 to enlarge and frictionally contact with the inner sidewall 248 of the casing 126 (better shown in FIGS. 25 and 26). The frictional contact of the torsion spring 250 with the casing 126 can counteract the torque N applied by the vertical weight on the rotary drum 128, and block rotation of the torsion spring 250 and the rotary drum 128 in a direction of lowering the bottom part 106. The bottom part 106 can be thereby kept stationary at a desired height.

Figure 33:
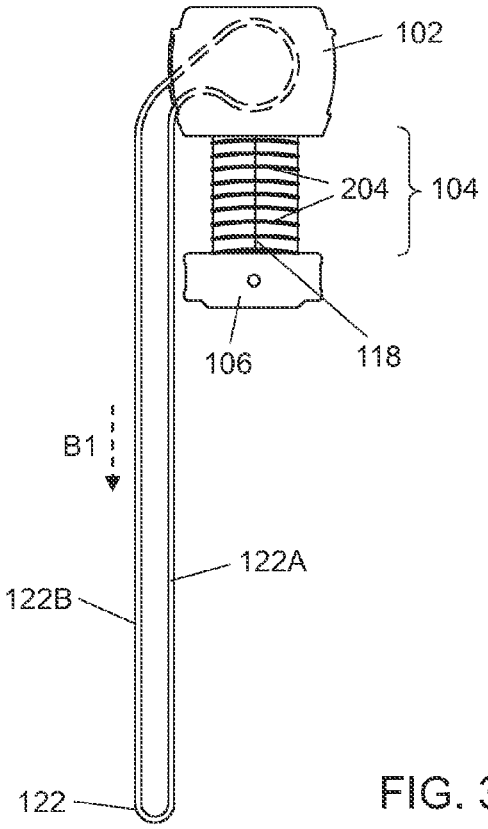
FIG. 33 is a schematic view illustrating exemplary actuation of the window shade of FIG. 23 for tilting slats in one direction.
Figure 34:
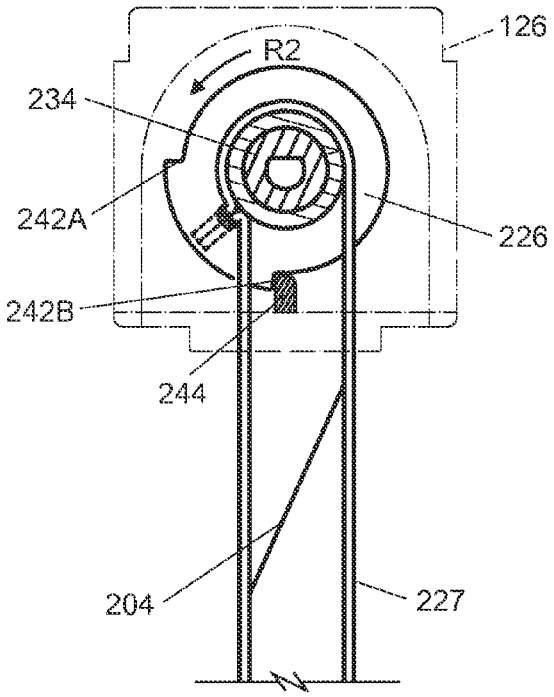
FIG. 34 is a schematic view illustrating exemplary operation of the tilting mechanism occurring when the window shade is actuated as shown in FIG. 33.

Referring to FIGS. 33 and 34 in conjunction with FIGS. 26 and 27, when the inclination of the slats 204 is to be adjusted in one direction, the segment 122B of the looped cord 122 can be pulled downward by a displacement B1, which drives rotation of the transmission axle 112 and the coupling part 224 to rotate in the direction R2 and cause the post 246 to push against one of the two prongs 228A and 228B (e.g., the prong 228A), which causes the torsion spring 228 and the pulley 226 to rotate in unison relative to the rotary drum 128 owing to the frictional contact between the torsion spring 228 and the sleeve portion 238. This rotation of the pulley 226 can drive vertical displacement of the ladder cord 227 so as to tilt the slats 204 in the first direction as shown in FIG. 34. The pulley 226 can rotate until it is stopped by the contact between the stop rib 244 and the flange surface 242B, which delimits the maximal tilt angle of the slats 204 in this direction.

Figure 35:
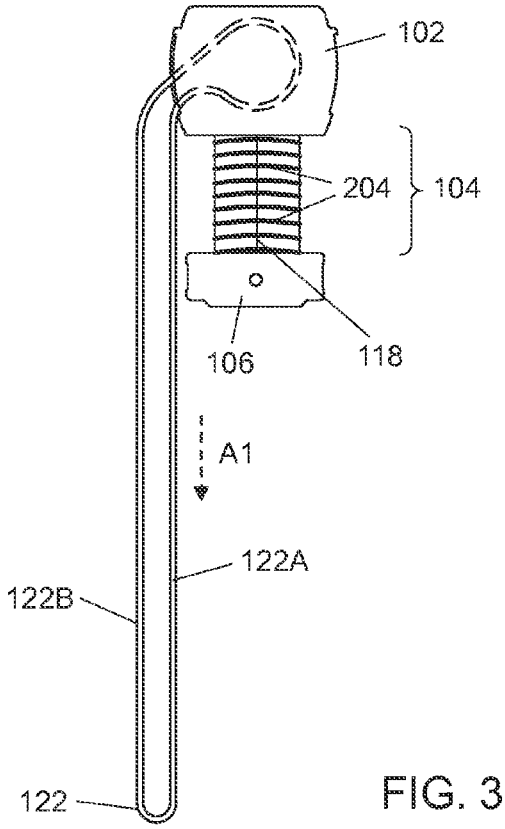
FIG. 35 is a schematic view illustrating exemplary actuation of the window shade of FIG. 23 for tilting slats in another direction.
Figure 36:
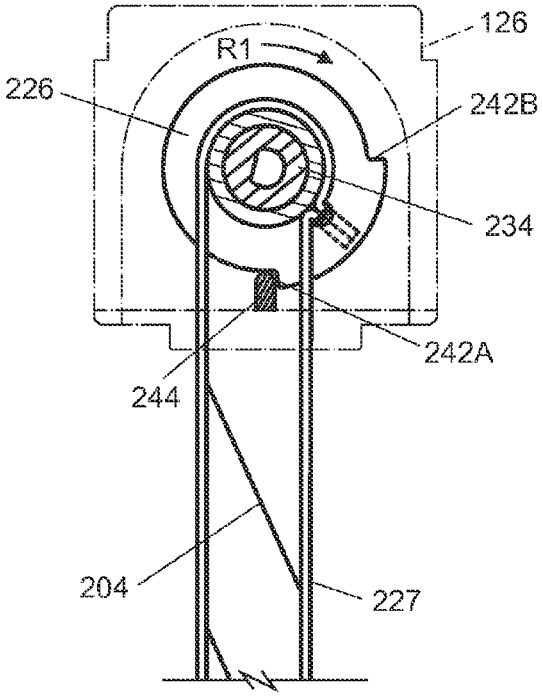
FIG. 36 is a schematic view illustrating exemplary operation of the tilting mechanism occurring when the window shade is actuated as shown in FIG. 35.

Referring to FIGS. 35 and 36 in conjunction with FIGS. 26 and 27, when the inclination of the slats 204 is to be adjusted in a second direction opposite to the first direction, the segment 122A of the looped cord 122 can be pulled downward by a displacement A1, which drives rotation of the transmission axle 112 and the coupling part 224 to rotate in the direction R1 and cause the post 246 to push against the other one of the two prongs 228A and 228B (e.g., the prong 228B), which causes the torsion spring 228 and the pulley 226 to rotate in unison relative to the rotary drum 128 owing to the frictional contact between the torsion spring 228 and the sleeve portion 238. This rotation of the pulley 226 can drive vertical displacement of the ladder cord 227 so as to tilt the slats 204 in the second direction as shown in FIG. 36. The pulley 226 can rotate until it is stopped by the contact between the stop rib 244 and the flange surface 242A, which delimits the maximal tilt angle of the slats 204 in the second direction.

Figure 37:
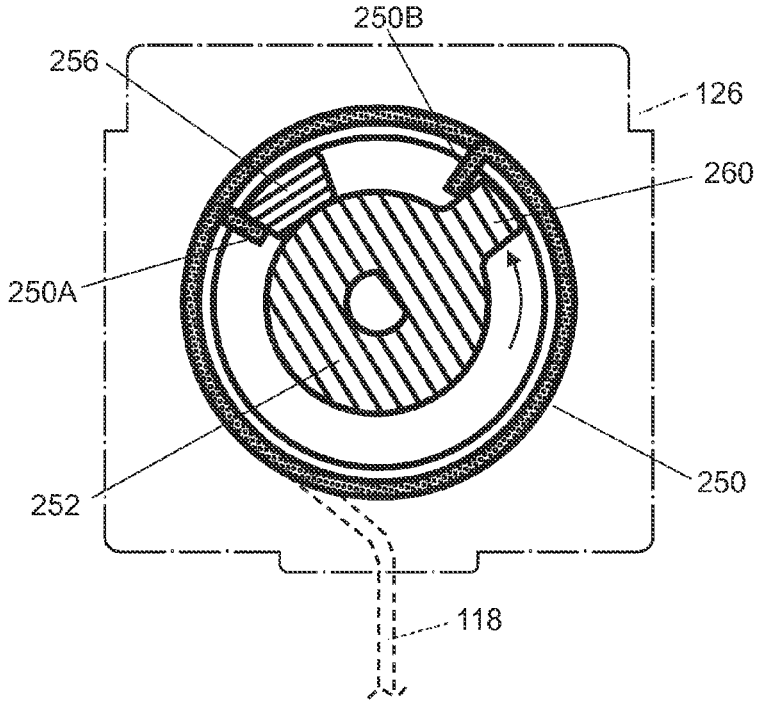
FIG. 37 is a cross-sectional view illustrating an exemplary displacement occurring in the clutch unit when the tilting mechanism is actuated as shown in FIG. 34.
Figure 38:
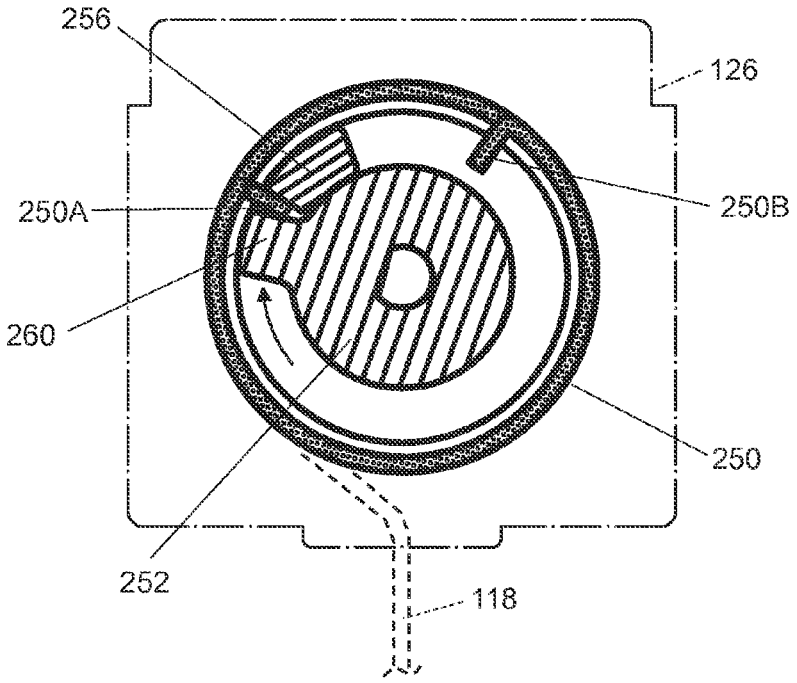
FIG. 38 is a cross-sectional view illustrating an exemplary displacement occurring in the clutch unit when the tilting mechanism is actuated as shown in FIG. 36.

It is noted that while the pulley 226 rotates to modify the tilt angle of the slats 204, the actuating part 252 is also driven in rotation by the transmission axle 112 in the same direction as the pulley 226. However, as long as the stop rib 244 does not reach any of the flange surfaces 242A and 242B, the protrusion 260 of the actuating part 252 does not push against any of the two prongs 250A and 250B, and no contraction of the torsion spring 250 occurs. FIG. 37 exemplary illustrates a course of the protrusion 260 occurring when the slats 204 are adjusted as shown in FIG. 34, and FIG. 38 exemplary illustrates a course of the protrusion 260 occurring when the slats 204 are adjusted as shown in FIG. 36. As a result, while the tilt angle of the slats 204 is adjusted, the vertical weight exerted by the bottom part 106 on the rotary drum 128 can continuously urge the flange 256 against the prong 250A, and the torsion spring 250 can thereby remain in frictional contact with the casing 126. Accordingly, the rotary drum 128 and the bottom part 106 can be held stationary by the action of the torsion spring 250 like previously described during adjustment of the tilt angle of the slats 204.

Figure 39:
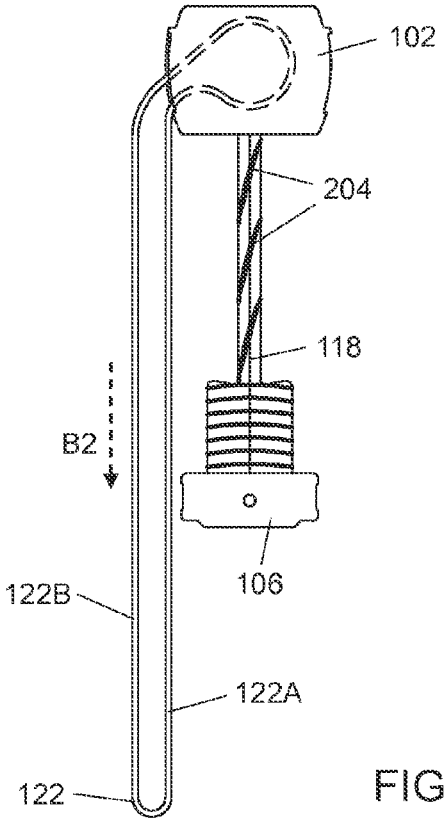
FIG. 39 is a schematic view illustrating exemplary actuation of the window shade shown in FIG. 23 for lowering the bottom part.
Figure 40:
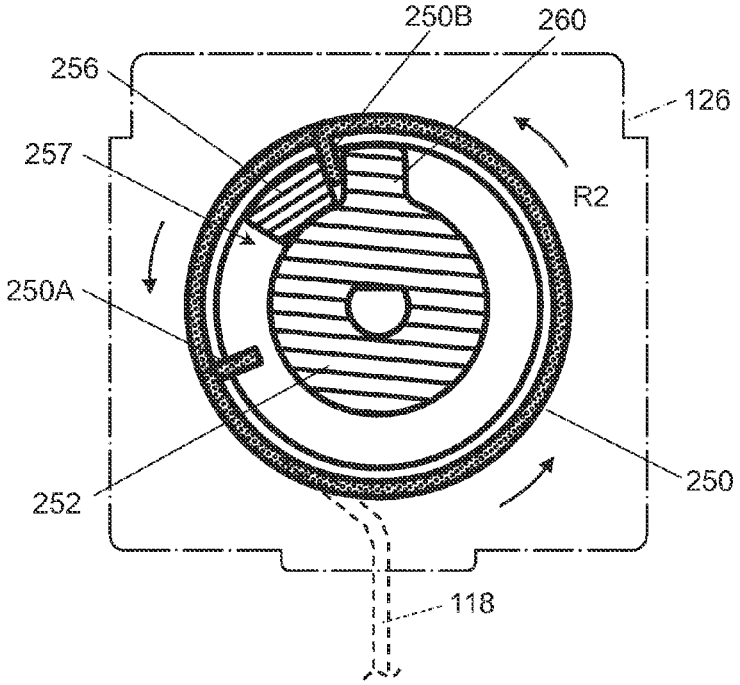
FIG. 40 is a cross-sectional view illustrating a displacement occurring in the clutch unit upon actuation of the window shade as shown in FIG. 39.

Referring to FIGS. 39 and 40 in conjunction with FIGS. 26-30, for lowering the bottom part 106, the segment 122B of the looped cord 122 can be pulled downward by a displacement B2 greater than the displacement B1 for tilting the slats 204. As a result, the transmission axle 112 rotates in the direction R2, which drives concurrent rotation of the coupling part 224 and the actuating part 252 in the same direction. The coupling part 224 can thereby rotate and cause the post 246 to push against the prong 228A, which drives the torsion spring 228 and the pulley 226 to rotate until the stop rib 244 abuts against the flange surface 242B, as previously described with reference to FIG. 34. As the segment 122B of the looped cord 122 continues to move downward after the stop rib 244 abuts against the flange surface 242B, the pulley 226 can remain stationary, and the actuating part 252 can continue to rotate with the transmission axle 112 in the direction R2 to displace the protrusion 260 away from the prong 250A toward the prong 250B. As a result, the protrusion 260 can push against the prong 250B of the torsion spring 250 in a direction that narrows the gap 257, which causes contraction of the torsion spring 250 so as to loosen its frictional contact with the inner sidewall 248 of the casing 126. The loosened torsion spring 250 then can rotate with the actuating part 252 and the transmission axle 112 in the direction R2, and the prong 250B can push against the flange 256 of the rotary drum 128 to cause rotation of the rotary drum 128 in the same direction R2, as shown in FIG. 40. The rotation of the torsion spring 250 driven by the transmission axle 112 thus can be transmitted to the rotary drum 128 via the contact between the prong 250B and the flange 256 of the rotary drum 128, which can result in a rotation of the rotary drum 128 for unwinding the suspension member 118 and lowering the bottom part 106.

Once the bottom part 106 moving downward has reached a desired height, the looped cord 122 can be released such that the protrusion 260 no longer pushes against the prong 250B of the torsion spring 250. As a result, the vertical weight exerted by the bottom part 106 on the suspension member 118 can result in the application of the torque N on the rotary drum 128, which rotationally urges the rotary drum 128 to push the flange 256 against the prong 250A, as previously shown in FIG. 32. This pushing force is in a direction that tends to push the prong 250A away from the prong 250B (i.e., the direction widening the gap 257), which urges the torsion spring 250 to enlarge and frictionally contact with the inner sidewall 248 of the casing 126. The frictional contact of the torsion spring 250 with the casing 126 can counteract the torque applied by the vertical weight on the rotary drum 128, and can block rotation of the torsion spring 250, the rotary drum 128 and the transmission axle 112 in the direction R2 for unwinding the suspension member 118. Accordingly, the bottom part 106 can be held stationary at a desired height.

Figure 41:
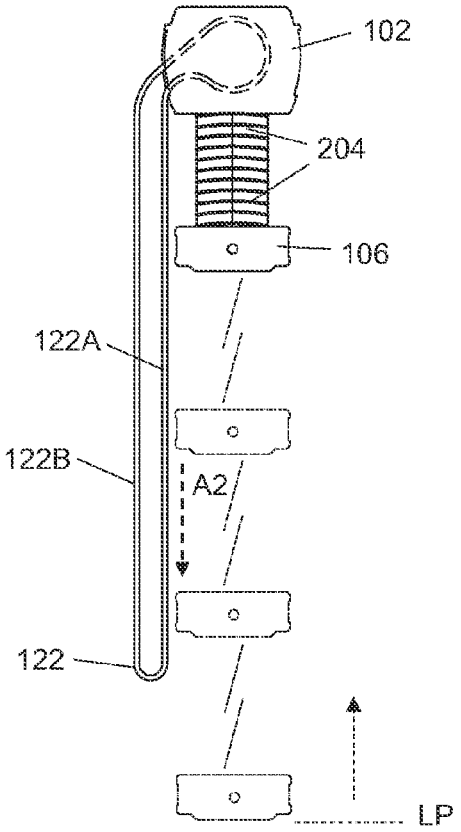
FIG. 41 is a schematic view illustrating exemplary actuation of the window shade shown in FIG. 23 for raising the bottom part.
Figure 42:
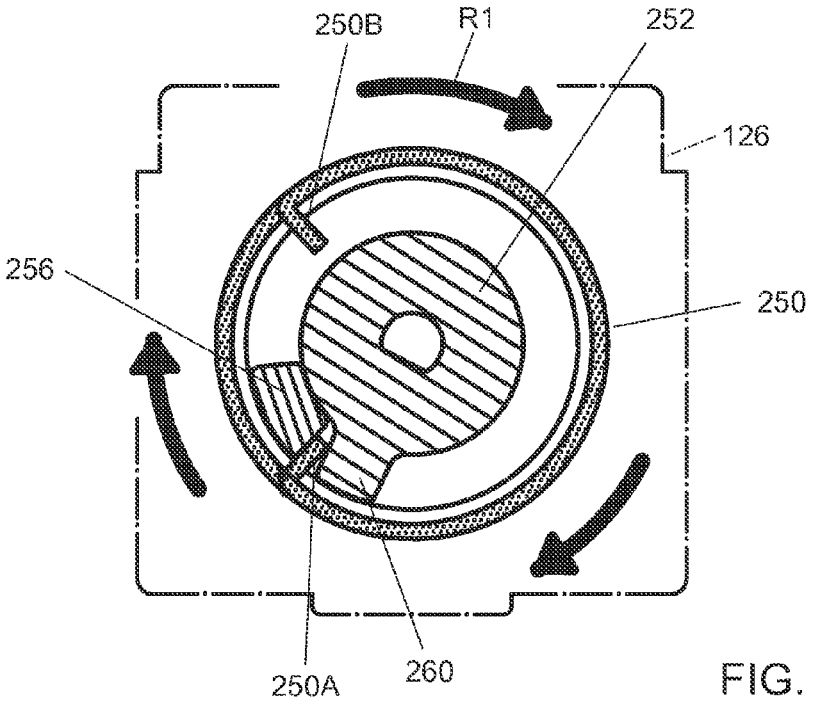
FIG. 42 is a cross-sectional view illustrating a displacement occurring in the clutch unit upon actuation of the window shade as shown in FIG. 41.

Referring to FIGS. 41 and 42 in conjunction with FIGS. 26-30, for raising the bottom part 106, the segment 122A of the looped cord 122 can be pulled downward by a displacement A2 greater than the displacement A1 for tilting the slats 204. As a result, the transmission axle 112 rotates in the direction R1, which drives concurrent rotation of the coupling part 224 and the actuating part 252 in the same direction. The coupling part 224 can thereby rotate and cause the post 246 to push against the prong 228B, which drives the torsion spring 228 and the pulley 226 to rotate until the stop rib 244 abuts against the flange surface 242A as described previously with reference to FIG. 36. As the segment 122A of the looped cord 122 continues to move downward after the stop rib 244 abuts against the flange surface 242A, the pulley 226 remains stationary, and the actuating part 252 can continue to rotate with the transmission axle 112 and urge the protrusion 260 to move away from the prong 250B toward the prong 250A of the torsion spring 250. As a result, the protrusion 260 can push against the prong 250A of the torsion spring 250 to cause its contraction and loosens its frictional contact with the inner sidewall 248 of the casing 126. Accordingly, the loosened torsion spring 250 can rotate with the actuating part 252 so as to cause the prong 250A to push against the flange 256 of the rotary drum 128 in the direction R1. This rotation of the torsion spring 250 driven by the transmission axle 112 then can be transmitted to the rotary drum 128 via the contact between the prong 250A and the flange 256 of the rotary drum 128, which can result in a rotation of the rotary drum 128 for winding the suspension member 118 and raising the bottom part 106.

Once the bottom part 106 moving upward has reached a desired height, the looped cord 122 can be released such that the protrusion 260 no longer pushes against the prong 250A of the torsion spring 250. As described previously, the vertical weight exerted by the bottom part 106 on the suspension member 118 then can result in the application of a torque on the rotary drum 128, which rotationally urges the rotary drum 128 in the direction R2 that causes the flange 256 to push against the prong 250A. The torsion spring 250 is thereby urged to enlarge and frictionally contact with the inner sidewall 248 of the casing 126. The frictional contact of the torsion spring 250 with the casing 126 can counteract the torque applied by the vertical weight on the rotary drum 128, and block rotation of the torsion spring 250, the rotary drum 128 and the transmission axle 112 in the direction R2 unwinding the suspension member 118. Accordingly, the bottom part 106 can be held stationary at a desired height.

Like previously described, while the rotary drum 128 rotates for winding and unwinding the suspension member 118, the retaining part 138 can hold the impeding part 130 in the retracted position so that the impeding part 130 is movable with the rotary drum 128 past the fixed protrusion 132 of the casing 126. Moreover, when the bottom part 106 nears its lowermost position, the impeding part 138 can be driven by the weight load of the bottom part 106 to displace from the retracted position to the deployed position at which it can engage with the fixed protrusion 132 of the casing 126 to stop the bottom part 106 adjacent to the lowermost position.

The structures and operating methods described herein can define the number of revolutions of the rotary drum for lowering the shading structure from the head rail to the lowermost position, such that rotation of the rotary drum can be automatically stopped when the shading structure moving downward is adjacent to a lowermost position. The actuating system can thus be operated in a consistent manner to raise and lower a shading structure of the window shade.

Realizations of the structures and methods have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. An actuating system for a window shade, comprising:

a suspension member;

a casing having a fixed protrusion;

a transmission axle disposed through the casing;

a rotary drum arranged in the casing and rotationally coupled with the transmission axle, the rotary drum being rotatable in a first direction for winding the suspension member around the rotary drum, and in a second direction for unwinding the suspension member from the rotary drum; and an impeding part connected with the rotary drum and affixed with an end of the suspension member, the impeding part being switchable between a first and a second position with respect to the rotary drum, the impeding part while remaining in the first position on the rotary drum being movable in unison with the rotary drum past the protrusion during rotation of the rotary drum in any of the first and second direction, and the impeding part when in the second position on the rotary drum being engageable with the protrusion to block rotation of the rotary drum in the second direction, the impeding part being switchable from the first position to the second position by a force exerted through the suspension member on the impeding part.

2. The actuating system according to claim 1, wherein the impeding part is in the second position when the suspension member is substantially or entirely unwound from the rotary drum.

3. The actuating system according to claim 1, wherein the rotary drum has a first and a second end portion, the impeding part being connected with the rotary drum near the first end portion, and the suspension member winding around the rotary drum from the first end portion toward the second end portion.

4. The actuating system according to claim 1, wherein the rotary drum has an outer surface around which the suspension member is wound, and an opening formed in the outer surface, the impeding part when in the second position protruding outward from the outer surface, and the impeding part when in the first position retracting toward an interior of the opening.

5. The actuating system according to claim 1, wherein the rotary drum is rotatable about a rotation axis, and the protrusion is arranged at a location that is offset from a vertical axis intersecting the rotation axis.

6. The actuating system according to claim 1, wherein the impeding part is pivotally connected with the rotary drum about a shaft portion that is parallel to a rotation axis of the rotary drum.

7. The actuating system according to claim 6, wherein the suspension member is affixed with the impeding part at a location offset from the shaft portion.

8. A window shade including:

a head rail, a bottom rail, and a shading structure arranged vertically between the head rail and the bottom rail; and the actuating system according to claim 1 arranged in the head rail, the suspension member of the actuating system having a second end connected with the bottom rail, and the transmission axle being operable to drive the rotary drum in rotation for raising and lowering the bottom rail.

9. The window shade according to claim 8, wherein when the suspension member is substantially or entirely unwound from the rotary drum, a weight load exerted by the bottom rail on the suspension member pulls the impeding part to move from the first position to the second position.

10. The actuating system according to claim 1, further including a retaining part affixed with the rotary drum adjacent to the impeding part, the retaining part being operable to retain the impeding part in the first position, and the suspension member applying a force on the impeding part that overcomes the retaining part for switching the impeding part from the first position to the second position.

11. The actuating system according to claim 10, wherein the retaining part includes a detent, the impeding part being retained in the first position by engaging with the detent.

12. The actuating system according to claim 10, wherein the rotary drum has an inner cavity, and an outer surface around which the suspension member is wound, the impeding part when in the second position protruding outward from the outer surface, and the impeding part when in the first position is retained in the inner cavity by the retaining part.

13. The actuating system according to claim 1, further including a clutch unit having a locking state in which the clutch unit prevents rotation of the rotary drum in the second direction, and an unlocking state in which rotation of the rotary drum is allowed, a switch of the clutch unit from the locking state to the unlocking state being triggered by a rotation of the transmission axle.

14. The actuating system according to claim 13, wherein the clutch unit is assembled in the casing adjacent to the rotary drum, the clutch unit when in the locking state being frictionally engaged with a sidewall of the casing.

15. The actuating system according to claim 13, further including a pulley assembled around the transmission axle, and a ladder cord connected with the pulley, wherein the rotary drum has a first and a second end portion opposite to each other, the clutch unit being arranged adjacent to the first end portion of the rotary drum, and the pulley being arranged adjacent to the second end portion of the rotary drum.

16. The actuating system according to claim 1, further including:

a pulley affixed with a sleeve portion, the pulley being assembled around the transmission axle;

a ladder cord connected with the pulley;

a second torsion spring having two spaced-apart second prongs and assembled in frictional contact with the sleeve portion of the pulley; and a coupling part rotationally coupled with the transmission axle, wherein the coupling part is driven in rotation by the transmission axle to push against any of the two second prongs and drive a rotational displacement of the second torsion spring and the pulley relative to the rotary drum.

17. The actuating system according to claim 16, wherein the coupling part has a sleeve segment that extends through an interior of the rotary drum.

18. The actuating system according to claim 16, wherein the pulley has a first and a second flange surface, and the casing is affixed with a stop rib, the pulley having a range of rotational displacement that is delimited between a first angular position where the first flange surface contacts with the stop rib and a second angular position where the second flange surface contacts with the stop rib.

19. The actuating system according to claim 1, wherein the rotary drum is affixed with a flange, and the actuating system further includes:

a torsion spring having two spaced-apart prongs and assembled in the casing, the flange being placed in a gap between the two prongs, wherein a pressure applied by the flange on any of the two prongs urges the torsion spring to frictionally contact with a sidewall of the casing so as to prevent rotation of the rotary drum in the second direction; and an actuating part rotationally coupled with the transmission axle, wherein the actuating part is drivable in rotation by the transmission axle to push against any of the two prongs to loosen the frictional contact of the torsion spring with the sidewall of the casing, whereby a rotation of the transmission axle is transmittable via the actuating part and the torsion spring to the rotary drum.

20. The actuating system according to claim 19, wherein a rotation of the torsion spring driven by the transmission axle is transmitted to the rotary drum via a contact between one of the two prongs and the flange.

21. The actuating system according to claim 19, wherein the actuating part includes a protrusion, and the transmission axle and the actuating part are rotatable in unison relative to the rotary drum to drive a displacement of the protrusion away from a first one of the two prongs toward a second one of the two prongs, the protrusion pushing against the second prong for loosening the frictional contact of the torsion spring with the sidewall of the casing.

22. The actuating system according to claim 19, wherein the actuating part is assembled through the torsion spring, and the transmission axle respectively extends through the rotary drum and the actuating part.

23. The actuating system according to claim 19, further including:

a pulley affixed with a sleeve portion, the pulley being assembled around the transmission axle;

a ladder cord connected with the pulley;

a second torsion spring having two spaced-apart second prongs and assembled in frictional contact with the sleeve portion of the pulley; and a coupling part rotationally coupled with the transmission axle, wherein the coupling part is driven in rotation by the transmission axle to push against any of the two second prongs and drive a rotational displacement of the second torsion spring and the pulley relative to the rotary drum.

24. The actuating system according to claim 23, wherein the coupling part has a sleeve segment that extends through the rotary drum and is partially received in an interior of the actuating part.

25. An actuating system for a window shade, comprising:

a suspension member;

a casing having a fixed protrusion;

a transmission axle disposed through the casing;

a rotary drum arranged in the casing and rotationally coupled with the transmission axle, the rotary drum being rotatable in a first direction for winding the suspension member around the rotary drum, and in a second direction for unwinding the suspension member from the rotary drum;

an impeding part connected with the rotary drum and affixed with an end of the suspension member, the impeding part being switchable between a first and a second position with respect to the rotary drum, the impeding part while remaining in the first position on the rotary drum being movable with the rotary drum past the protrusion during rotation of the rotary drum in any of the first and second direction, and the impeding part when in the second position on the rotary drum being engageable with the protrusion to block rotation of the rotary drum in the second direction;

a clutch unit having a locking state in which the clutch unit prevents rotation of the rotary drum in the second direction, and an unlocking state in which rotation of the rotary drum is allowed, a switch of the clutch unit from the locking state to the unlocking state being triggered by a rotation of the transmission axle; and a pulley assembled around the transmission axle, and a ladder cord connected with the pulley, wherein the rotary drum has a first and a second end portion opposite to each other, the clutch unit being arranged adjacent to the first end portion of the rotary drum, and the pulley being arranged adjacent to the second end portion of the rotary drum.

26. An actuating system for a window shade, comprising:

a suspension member;

a casing having a fixed protrusion;

a transmission axle disposed through the casing;

a rotary drum arranged in the casing and rotationally coupled with the transmission axle, the rotary drum being rotatable in a first direction for winding the suspension member around the rotary drum, and in a second direction for unwinding the suspension member from the rotary drum; and an impeding part connected with the rotary drum and affixed with an end of the suspension member, the impeding part being switchable between a first and a second position with respect to the rotary drum, and the end of the suspension member being movable in unison with the impeding part relative to the rotary drum, the impeding part while remaining in the first position on the rotary drum being movable with the rotary drum past the protrusion during rotation of the rotary drum in any of the first and second direction, and the impeding part when in the second position on the rotary drum being engageable with the protrusion to block rotation of the rotary drum in the second direction.

27. The actuating system according to claim 26, wherein the suspension member is operable to urge the impeding part in movement relative to the rotary drum.

28. The actuating system according to claim 26, wherein the impeding part is in the second position when the suspension member is substantially or entirely unwound from the rotary drum.

29. The actuating system according to claim 26, wherein the rotary drum has an outer surface around which the suspension member is wound, and an opening formed in the outer surface, the impeding part when in the second position protruding outward from the outer surface, and the impeding part when in the first position retracting toward an interior of the opening.

30. The actuating system according to claim 26, wherein the impeding part is pivotally connected with the rotary drum about a shaft portion that is parallel to a rotation axis of the rotary drum.

31. The actuating system according to claim 30, wherein the end of the suspension member is affixed with the impeding part at a location offset from the shaft portion.

32. The actuating system according to claim 26, further including a retaining part affixed with the rotary drum adjacent to the impeding part, the retaining part being operable to retain the impeding part in the first position, and the suspension member applying a force on the impeding part that overcomes the retaining part for switching the impeding part from the first position to the second position.

33. The actuating system according to claim 32, wherein the retaining part includes a detent, the impeding part being retained in the first position by engaging with the detent.

* * * * *